US006030734A

United States Patent [19]

Mitsumori

[11] Patent Number: 6,030,734

[45] Date of Patent: Feb. 29, 2000

[54] ELECTROPHOTOGRAPHIC PHOTORECEPTOR CONTAINING CHARGE-TRANSPORTING MATERIAL WITH BUTADIENE STRUCTURE

[75] Inventor: Teruyuki Mitsumori, Yokohama, Japan

[73] Assignee: Mitsubishi Chemical Corporation, Tokyo, Japan

[21] Appl. No.: 09/115,537

[22] Filed: Jul. 15, 1998

Related U.S. Application Data

[63] Continuation-in-part of application No. 08/814,359, Mar. 11, 1997, Pat. No. 5,804,344.

[30] Foreign Application Priority Data

Mar. 11, 1996 [JP] Japan ..... 8-52964

[51] Int. Cl.[7] ..... G03G 5/047; G03G 5/06

[52] U.S. Cl. ..... 430/58.8; 430/83

[58] Field of Search ..... 430/59, 58.65, 430/58.8

[56] References Cited

U.S. PATENT DOCUMENTS

| | | | |
|---|---|---|---|
| 4,724,192 | 2/1988 | Makino et al. | 430/58 |
| 5,389,481 | 2/1995 | Saita et al. | 430/73 |
| 5,667,925 | 9/1997 | Tsuruoka et al. | 430/73 |

FOREIGN PATENT DOCUMENTS 0 506 492 9/1992 European Pat. Off. .

5-281761 10/1993 Japan .

OTHER PUBLICATIONS

Hayata, "Electrophotographic Sensitive Body," Jan. 21, 1994, Abstract of JP 6–11854.

Saito et al., "Electrophotographic Photoreceptor," Patent Abstracts of Japan, Feb. 7, 1995, Abstract of JP 7–36203.

Horie, "Electrophotographic Sensitive Body," Mar. 1, 1988, Abstract of JP 63–48553.

Suzuki, "Electrophotographic Sensitive Body," Jun. 13, 1990, Abstract of JP 2–154269.

Ueda, "New Styryl Compound and Photo–Sensitive Material Containing the Same," Oct. 15, 1992, Abstract of JP 4–290851.

Ueda, "Photosensitive Body," Jun. 23, 1987, Abstract of JP 62–139563.

*Primary Examiner*—John Goodrow
*Attorney, Agent, or Firm*—Oblon, Spivak, McClelland, Maier & Neustadt, P.C.

[57] ABSTRACT

An electrophotographic photoreceptor having a photosensitive layer containing a charge-generating material and a charge-transporting material on an electroconductive substrate, wherein the charge-transporting material has a butadiene structure and a total amount W of $\pi$ electron number and lone electron number of nitrogen of the charge-transporting material is at least 60.

6 Claims, 2 Drawing Sheets

ELECTROPHOTOGRAPHIC PHOTORECEPTOR CONTAINING CHARGE-TRANSPORTING MATERIAL WITH BUTADIENE STRUCTURE

This application is a continuation in part of 08/814,359, filed Mar. 11, 1997, now U.S. Pat. No. 5,804,344.

BACKGROUND OF THE INVENTION

1. Field of the Invention:

The present invention relates to an electrophotographic photoreceptor. More particularly, the present invention relates to an electrophotographic photoreceptor having very high sensitivity and performance, which has a photosensitive layer containing an organic photoconductive material.

2. Discussion of the Background

Heretofore, an inorganic photoconductive material such as selenium, cadmium sulfide or zinc oxide has been widely used in a photosensitive layer of an electrophotographic photoreceptor. However, the recovery of poisonous selenium and cadmium sulfide is required, and these compounds have various disadvantages that selenium is poor in heat resistance since it is crystallized by heat, that cadmium sulfide and zinc oxide are poor in moisture resistance, and that zinc oxide is poor in printing resistance. Thus, an effort for developing a novel photosensitive material is continued. Recently, an organic photoconductive material has been developed to be used as a photosensitive layer of an electrophotographic photoreceptor, and organic photoconductive materials have been practically utilized. As compared with an inorganic photoconductive material, an organic photoconductive material has advantages that it produces a light weight photosensitive material, that it is non-poisonous to environments, that it can be easily produced and that it can produce a transparent electrophotographic photoreceptor.

Recently, generation function and transportation function of a charge carrier are separated and born on respectively different compounds. Since such a function-separation type photosensitive material is effective for increasing sensitivity, this type is mainly developed and an organic photosensitive material for this type is practically utilized.

As a charge carrier-transporting medium, there are a case of using a high molecular photoconductive compound such as polyvinylcarbazole and a case of using a low molecular photoconductive compound dispersed and dissolved in a binder polymer.

Particularly, since an organic low molecular photoconductive compound is usable in combination with a binder polymer excellent in film formability, flexibility and adhesive property, a photosensitive material excellent in mechanical properties can be easily provided (see, for example, JP-A-60-196767, JP-A-60-218652, JP-A-60-233156, JP-A-63-48552, JP-A-1-267552, JP-B-3-39306, JP-A-3-113459, JP-A-3-123358 and JP-A-3-149560). However, it has been difficult to find a compound suitable for producing a highly sensitive photosensitive material.

Further, under continuous demand for high sensitivity, there are various problems that a residual potential is insufficient in view of electric properties, that a photoresponsiveness is poor, that a charge acceptance is lowered when used repeatedly, and that a residual potential is accumulated. In order to solve these problems, a technique for preventing the rise of a residual potential without impairing other properties of a photosensitive material by using, for example, two kinds of hydrazone compounds in combination, has been proposed (see JP-A-61-134767). However, well-balanced properties can not be always provided, and it is demanded to technically improve total properties of a photosensitive material in good balance.

Further, as a light source, a semiconductor laser is positively used in the field of a printer. In such a case, since the wavelength of the light source is in the vicinity of 800 nm, the development of a photosensitive material having a high sensitivity to a long wavelength light in the vicinity of 800 nm is strongly demanded.

As a material to satisfy this demand, there are reported such materials as disclosed in JP-A-59-49544, JP-A-59-214034, JP-A-61-109056, JP-A-61-171771, JP-A-61-217050, JP-A-61-239248, JP-A-62-67094, JP-A-62-134651, JP-A-62-275272, JP-A-63-198067, JP-A-63-198068, JP-A-63-210942, JP-A-63-218768, JP-A-62-36674, JP-A-7-36203, JP-A-6-110228, JP-A-6-11854, JP-A-63-48553, JP-A-62-139563, JP-A-2-154269 and JP-A-4-290851, and there are known various oxytitaniumphthalocyanines having a crystal type suitable as an electrophotographic photoreceptor material. However, further, there has been demanded an electrophotographic photoreceptor having a high sensitivity to a long wavelength light and satisfactory other electric properties. Also, the above patent publications do not disclose such a compound having substituents of the formula (2) and the formula (2') in the arylamine type compound having the formula (1),

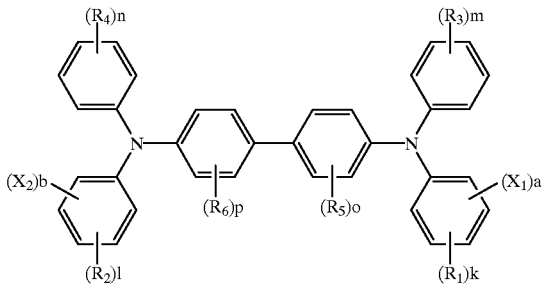

wherein each of $R_1$, $R_2$, $R_3$, $R_4$, $R_5$ and $R_6$ may be the same or different, and is a halogen atom, an alkyl group which may have one or more substituents, an alkoxy group which may have one or more substituents, an aryl group which may have one or more substituents or a substituted amino group;

each of k, l, m, n, o and p is an integer of from 0 to 4, and when the integer is two or more, a plurality of each of $R_1$ to $R_6$ may be the same or different;

$X_1$ has the formula (2); $-(CR_7{=}CR_8)_i-CR_9{=}CR_{10}R_{11}$ (2), and $X_2$ has the formula (2'); $-(CR_{12}{=}CR_{13})_h-CR_{14}{=}CR_{15}R_{16}$ (2')

(wherein in the formulas (2) and (2'), i is an integer of from 1 to 4;

h is an integer of from 0 to 4;

each of $R_7$, $R_8$, $R_9$, $R_{10}$, $R_{11}$, $R_{12}$, $R_{13}$, $R_{14}$, $R_{15}$ and $R_{16}$ may be the same or different and is a hydrogen atom, an alkyl group which may have one or more substituents, an alkoxy group which may have one or more substituents, an aryl group which may have one or more substituents or a heterocyclic group which may have one or more substituents;

a pair of $R_{10}$ and $R_{11}$ or a pair of $R_{15}$ and $R_{16}$ may be condensed to form a carbon-cyclic group or a heterocyclic group, provided that when one of the pair of $R_{10}$ and $R_{11}$ and the pair of $R_{15}$ and $R_{16}$ is a hydrogen atom or an alkyl group, the other is an aryl group or a heterocyclic group;

when i is from 2 to 4, each of $R_7$ and $R_8$ may be the same or different; and when h is from 2 to 4, each of $R_{15}$ and $R_{16}$ may be the same or different;

and these groups $X_1$ and $X_2$ may be the same or different).

When a hole moves to an adjacent charge-transporting material (CTM) molecule, the hole is liable to move to the highest occupied molecular orbital (HOMO) of the CTM molecule. HOMO of a molecule is widely distributed on a nitrogen atom and a double bonding π electron connected therewith, and accordingly a CTM molecule having a larger number of HOMO is considered to be a material having a high hole-moving capacity. It is therefore considered that a molecule having a higher total number of π electron number and lone electron number of nitrogen has a high hole-moving property. On the basis of this theory, various organic molecules have been studied, and it has been discovered that a molecule having a total amount W of π electron number and lone electron number of nitrogen of CTM of at least 60 is a molecule having a very high hole-moving capacity.

The present invention has been made for solving the above-mentioned problems, and the first object of the present invention is to provide an electrophotographic photoreceptor having a high sensitivity and a high durability.

The second object of the present invention is to provide an electrophotographic photoreceptor having a high sensitivity and an excellent durability and also having advantages that a residual potential is sufficiently low even when a coating thickness is large and that properties do not change even when used repeatedly.

The third object of the present invention is to provide an electrophotographic photoreceptor having a high sensitivity to a long wavelength in the vicinity of 800 nm and also having satisfactory well-balanced properties in respect to charge acceptance, dark decay and residual potential.

The fourth object of the present invention is to provide an electrophotographic photoreceptor having a good responsiveness and a high carrier mobility.

SUMMARY OF THE INVENTION

The present inventors have studied an organic low molecular photoconductive material which will satisfy the above objects, and have discovered a specific arylamine type compound is suitable. The present invention is made on the basis of this discovery.

The essential feature of the present invention resides in an electrophotographic photoreceptor having a photosensitive layer containing a charge-generating material and a charge-transporting material on an electroconductive substrate, wherein the charge-transporting material has a butadiene structure and a total number W of π electron number and lone electron number of nitrogen of the charge-transporting material is at least 60.

DETAILED DESCRIPTION OF THE INVENTION

Figure 1:
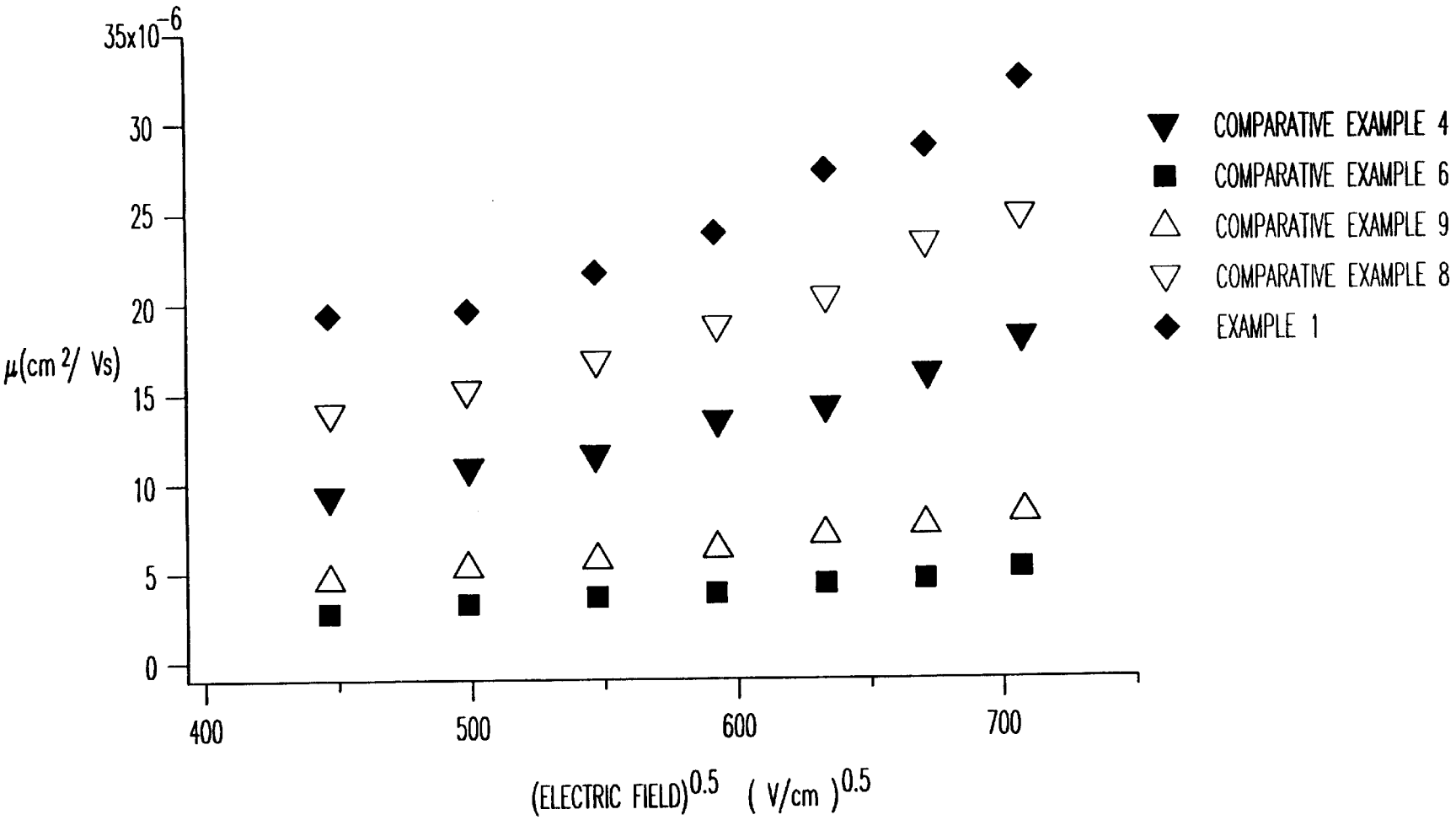

Among the above compounds, a molecule having a large amount of substituents having less HOMO distributed, is poor in the moving performance of CTM. Further, since an amount of CTM introduced into an electrophotographic photoreceptor is determined by its weight, it is considered to be advantageous that the value W per unit molecular weight is larger. Accordingly, among molecules having a value W of at least 60, a molecule having a value W/Mw (obtained by dividing a value W by a molecular weight Mw) of at least 0.065 has a particularly high hole-moving performance.

Also, when a nitrogen atom is introduced in an unnecessarily high amount into a molecule, a dipole moment is raised, and consequently this is disadvantageous for hole-moving performance. On the basis of this theory, among molecules having a total amount W (of π electron number and lone electron number of nitrogen of a material) of at least 60, a molecule having a lone electron number of nitrogen of at most 4 or a molecule having a value L (obtained by dividing lone electron number of nitrogen by π electron number) of at most 0.075, has a very high hole-moving performance.

Also, the value W is at least 60, but preferably at most 80 in view of solubility.

Further, the value L is more preferably at most 0.072 in view of hole-moving performance.

Still further, the value W/Mw is more preferably at least 0.07.

A typical example of a compound satisfying the above-mentioned conditions include a compound having the formula (1), (1)

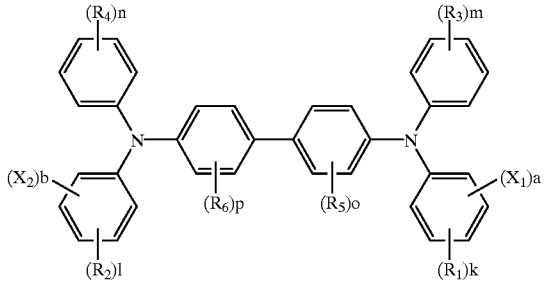

wherein each of $R_1$, $R_2$, $R_3$, $R_4$, $R_5$ and $R_6$ may be the same or different, and is a halogen atom, an alkyl group which may have one or more substituents, an alkoxy group which may have one or more substituents, an aryl group which may have one or more substituents or a substituted amino group;

each of k, l, m, n, o and p is an integer of from 0 to 4, and when the integer is two or more, a plurality of each of $R_1$ to $R_6$ may be the same or different;

$X_1$ has the formula (2); $-(CR_7{=}CR_8)_i-CR_9{=}CR_{10}R_{11}$ (2), and $X_2$ has the formula (2'); $-(CR_{12}{=}CR_{13})_h-CR_{14}{=}CR_{15}R_{16}$ (2')

(wherein in the formulas (2) and (2'), i is an integer of from 1 to 4;

h is an integer of from 0 to 4;

each of $R_7$, $R_8$, $R_9$, $R_{10}$, $R_{11}$, $R_{12}$, $R_{13}$, $R_{14}$, $R_{15}$ and $R_{16}$ may be the same or different and is a hydrogen atom, an alkyl group which may have one or more substituents, an alkoxy group which may have one or more substituents, an aryl group which may have one or more substituents or a heterocyclic group which may have one or more substituents;

a pair of $R_{10}$ and $R_{11}$ or a pair of $R_{15}$ and $R_{16}$ may be condensed to form a carbon-cyclic group or a heterocyclic group, provided that when one of the pair of $R_{10}$ and $R_{11}$ and the pair of $R_{15}$ and $R_{16}$ is a hydrogen atom or an alkyl group, the other is an aryl group or a heterocyclic group;

when i is from 2 to 4, each of $R_7$ and $R_8$ may be the same or different; and when h is from 2 to 4, each of $R_{15}$ and $R_{16}$ may be the same or different);

and these groups may be the same or different.

The present invention is further described in more details hereinafter. The electrophotographic photoreceptor of the present invention contains an arylamine type compound of the formula (1) in a photosensitive layer.

In the formula (1), each of $R_1$, $R_2$, $R_3$, $R_4$, $R_5$ and $R_6$ may be the same or different, and is a halogen atom such as a fluorine atom, a chlorine atom, a bromine atom or an iodine atom; an alkyl group such as a methyl group, an ethyl group, a propyl group or an isopropyl group; an alkoxy group such as a methoxy group, an ethoxy group or a propyloxy group; an aryl group such as a phenyl group, a naphthyl group or a pyrenyl group; a dialkylamino group such as a dimethylamino group, a diarylamino group such as a diphenylamino group, a diaralkylamino group such as a dibenzylamino group, a diheterocyclic amino group such as a dipyridylamino group, a diallylamino group or a substituted amino group such as a all-substituted amino group having substituents of the above amino groups in combination. Particularly preferable examples include a methyl group and a phenyl group.

These alkyl groups and alkoxy groups may have substituents such as a hydroxyl group; a halogen atom such as a fluorine atom, a chlorine atom, a bromine atom or an iodine atom; an alkyl group such as a methyl group, an ethyl group, a propyl group, a butyl group, a hexyl group or an isopropyl group; an alkoxy group such as a methoxy group, an ethoxy group or a propyloxy group; an allyl group; an aralkyl group such as a benzyl group, a naphthylmethyl group or a phenethyl group; an aryloxy group such as a phenoxy group or a tolyloxy group; an arylalkoxy group such as a benzyloxy group or a phenethyloxy group; an aryl group such as a phenyl group or a naphthyl group; an arylvinyl group such as a styryl group or a naphthylvinyl group; an acyl group such as an acetyl group or a benzoyl group; a dialkylamino group such as a dimethylamino group or a diethylamino group; a diarylamino group such as a diphenylamino group or a dinaphthylamino group; a diaralkylamino group such as a dibenzylamino group or a diphenethylamino group; a diheterocyclic amino group such as a dipyridylamino group or a dithienylamino group; a diallylamino group or a substituted amino group such as a all-substituted amino group having substituents of the above amino groups in combination.

These substituents may be condensed each other to form a carbon-cyclic group by way of a single bond, a methylene group, an ethylene group, a carbonyl group, a vinylidene group or an ethylenylene group, or to form a heterocyclic ring containing an oxygen atom, a sulfur atom or a nitrogen atom.

Also, each of k, l, m, n, o and p is an integer of from 0 to 4, preferably 0 or 1.

In the formula (1), $X_1$ is the formula (2), $-(CR_7{=}CR_8)_i-CR_9{=}CR_{10}R_{11}$ (2), and $X_2$ is the formula (2'), $-(CR_{12}{=}CR_{13})_h-CR_{14}{=}CR_{15}R_{16}$ (2')

These groups may be the same or different, and in the formulas (2) and (2'), i is an integer of from 1 to 4, h is a integer of from 0 to 4, each of $R_7$, $R_8$, $R_9$, $R_{10}$, $R_{11}$, $R_{12}$, $R_{13}$, $R_{14}$, $R_{15}$ and $R_{16}$ may be the same or different, and is a hydrogen atom, an alkyl group such as a methyl group, an ethyl group or a propyl group, an alkoxy group such as a methoxy group or an ethoxy group, an aryl group such as a phenyl group, a naphthyl group, an anthracenyl group or a pyrenyl group, or a heterocyclic group such as a pyrrolyl group, a thienyl group, a furyl group or a carbazolyl group. The heterocyclic group is preferably a heterocyclic group having aromatic properties.

These alkyl groups, alkoxy groups, aryl groups and heterocyclic groups may have substituents.

Examples of the substituents include a hydroxyl group; a halogen atom such as a fluorine atom, a chorine atom, a bromine atom or an iodine atom; an alkyl group such as a methyl group, an ethyl group, a propyl group, a butyl group, a hexyl group or an isopropyl group; an alkoxy group such as a methoxy group, an ethoxy group or a propyloxy group; an allyl group; an aralkyl group such as a benzyl group, a naphthylmethyl group or a phenethyl group; an aryloxy group such as a phenoxy group or a tolyloxy group; an arylalkoxy group such as a benzyloxy group or a phenethyloxy group; an aryl group such as a phenyl group or a naphthyl group; an arylvinyl group such as a styryl group or a naphthylvinyl group; an acyl group such as an acetyl group or a benzoyl group; a dialkylamino group such as a dimethylamino group or a diethylamino group; a diarylamino group such as a diphenylamino group or a dinaphthylamino group; a diaralkylamino group such as a dibenzylamino group or a diphenethylamino group; a di-heterocyclic amino group such as a dipyridylamino group or a dithienylamino group; a diallylamino group; or a substituted amino group such as a all-substituted amino group having the above substituents of amino groups in combination.

These substituents may be condensed each other to form a carbon-cyclic group by way of a single bond, a methylene group, an ethylene group, a carbonyl group, a vinylidene group or an ethylenylene group, or to form a heterocyclic group containing an oxygen atom, a sulfur atom or a nitrogen atom.

When i is from 2 to 4, each of $R_7$ and $R_8$ may be the same or different, and when h is from 2 to 4, each of $R_{15}$ and $R_{16}$ may be the same or different, or a pair of $R_{10}$ and $R_{11}$ or a pair $R_{15}$ and $R_{16}$ may be condensed to form a carbon-cyclic group by way of a single bond, a methylene group, an ethylene group, a carbonyl group, a vinylidene group or an ethylenylene group, or to form a heterocyclic group containing an oxygen atom, a sulfur atom or a nitrogen atom. These cyclic groups may further contain substituents, examples of which include an alkyl group such as a methyl group, an ethyl group, a propyl group, a butyl group, a hexyl group or an isopropyl group, an aryl group such as a phenyl group or a naphthyl group, a cyano group, an alkoxycarbonyl group, an aryloxycarbonyl group, a nitro group, or a halogen atom such as a fluorine atom, a chlorine atom, a bromine or an iodine atom.

However, when one of the pair of $R_{10}$ and $R_{11}$ and the pair of $R_{15}$ and $R_{16}$ is a hydrogen atom or an alkyl group, the other is an aryl group or a heterocyclic group. Also, h and i are preferably at most 2 in view of solubility. More preferably, both h and i are 1.

Hereinafter, typical examples of an arylamine type compound of the formula (1) are illustrated, but these examples are only for illustration, and it should be noted that the arylamine type compound used in the present invention is not limited to these examples.

1
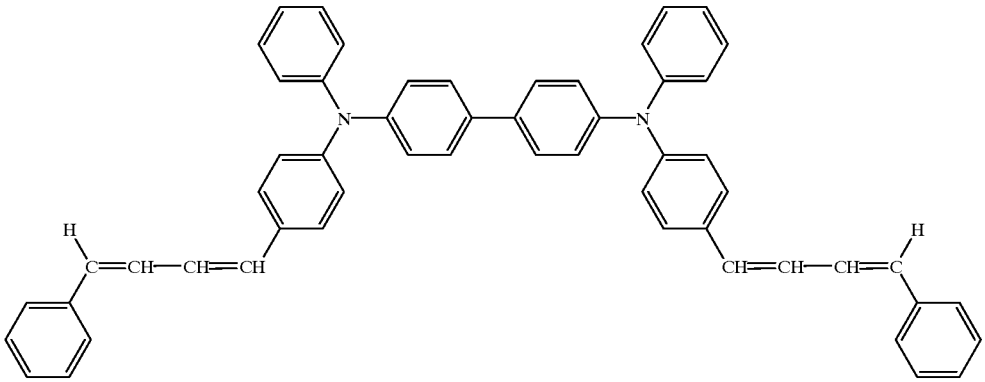
2
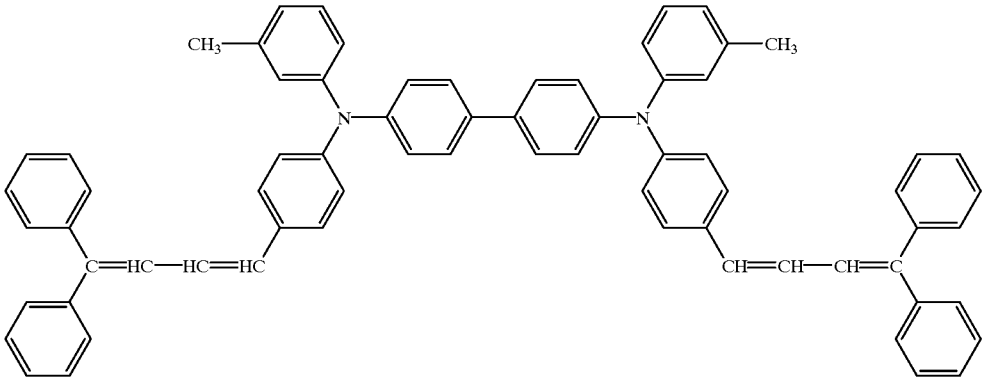
3
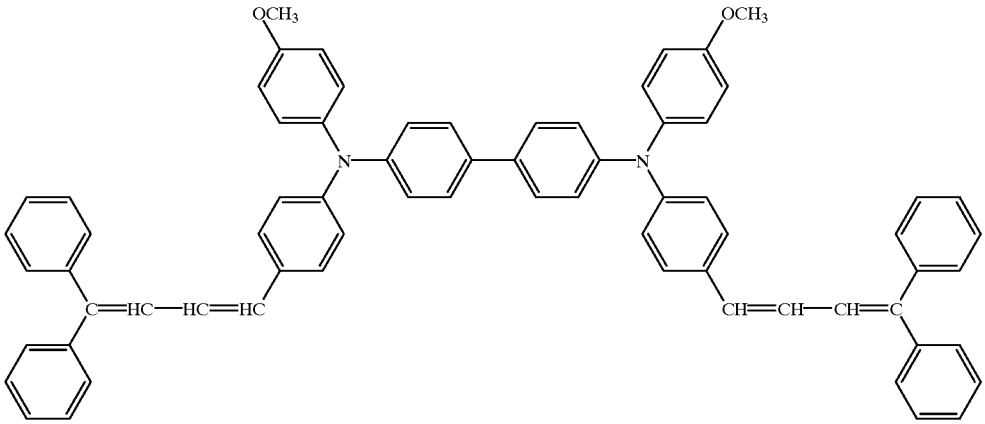
4
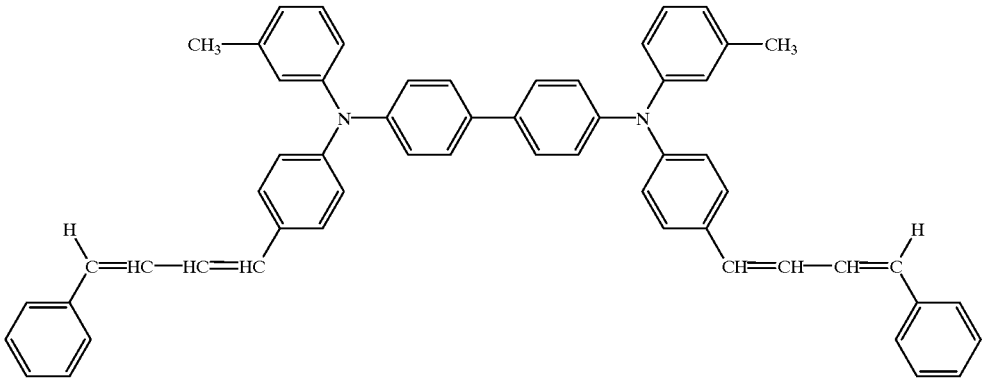

-continued
5
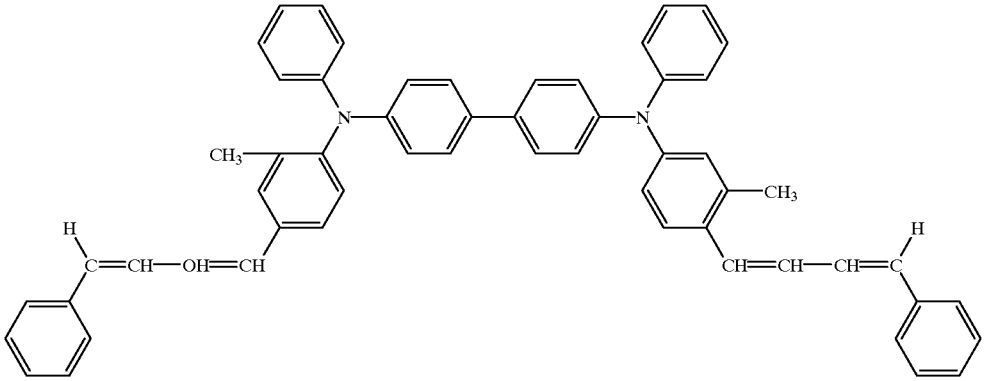
6
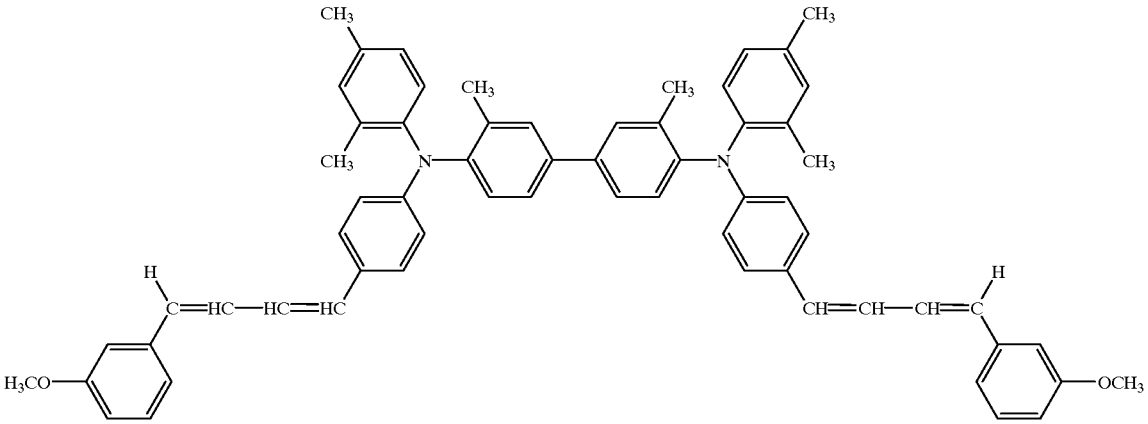
7
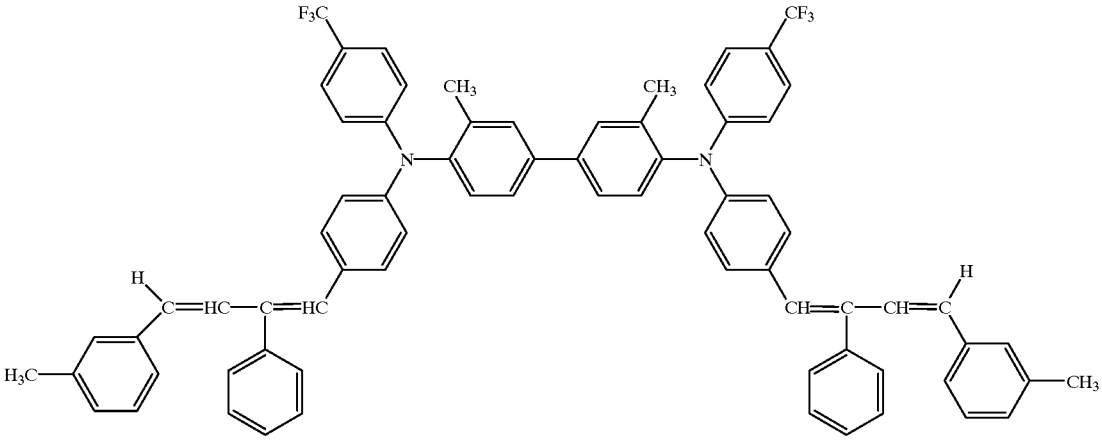

-continued
8
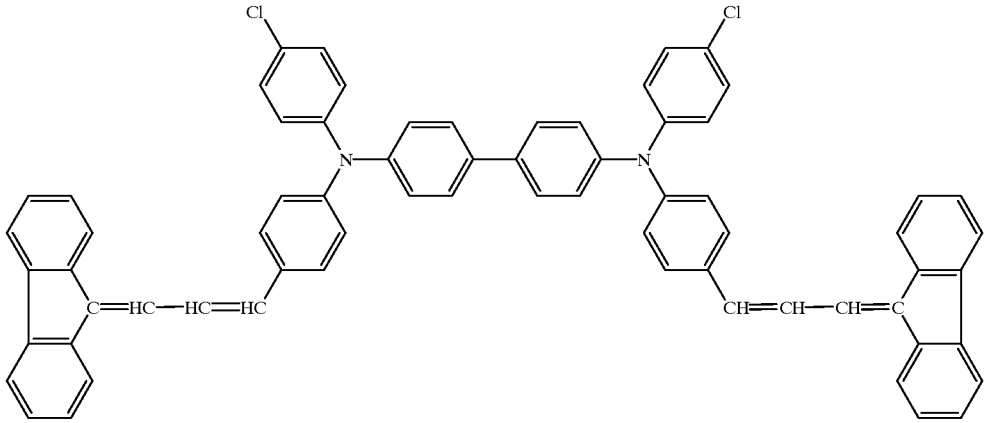
9
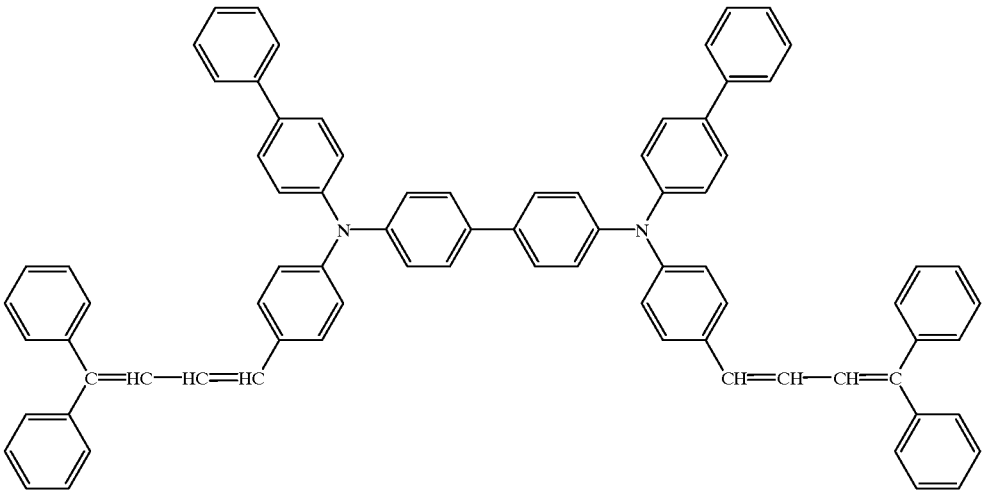
10
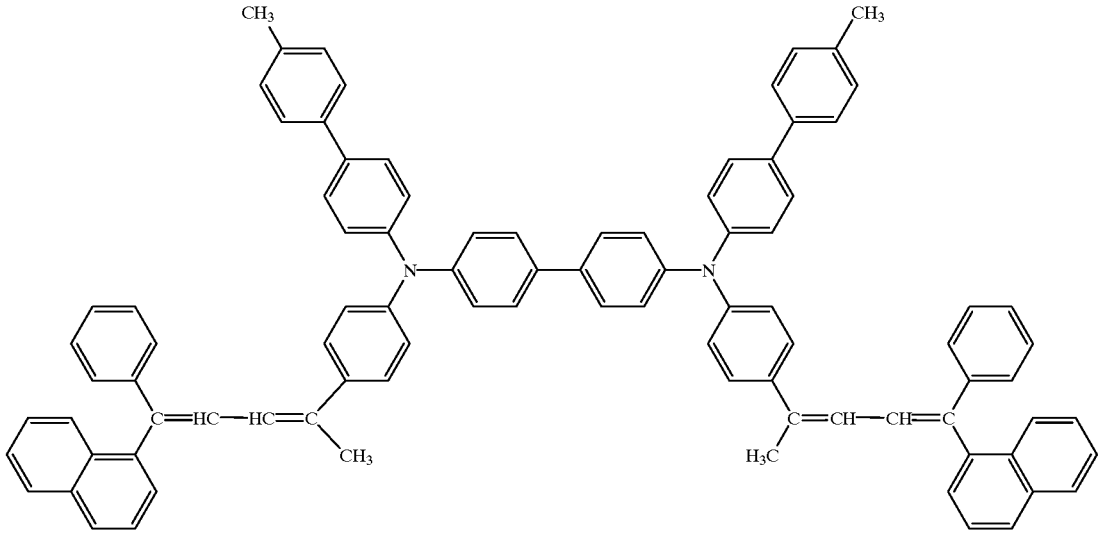

-continued
11
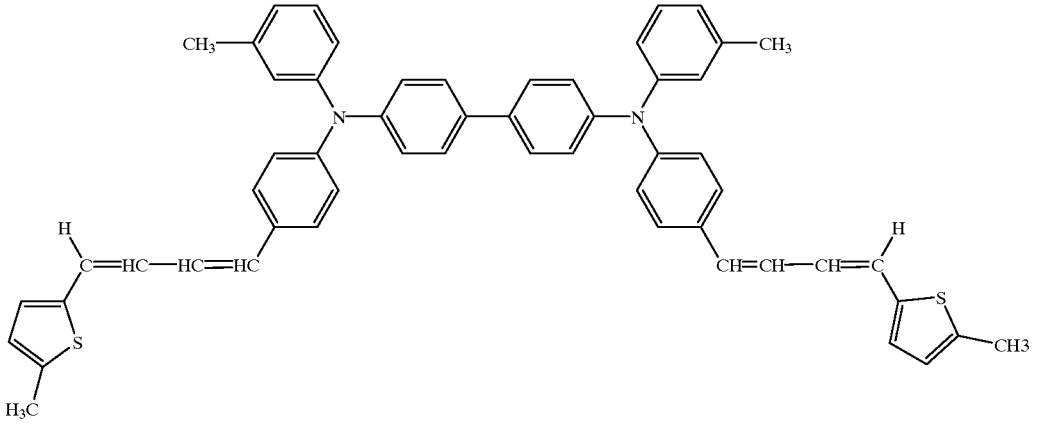
12
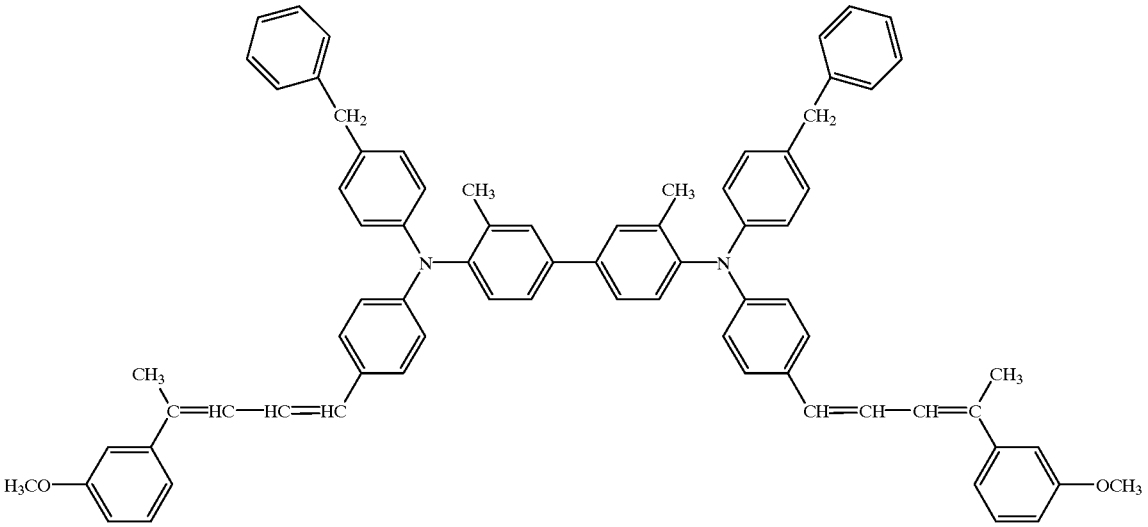
13
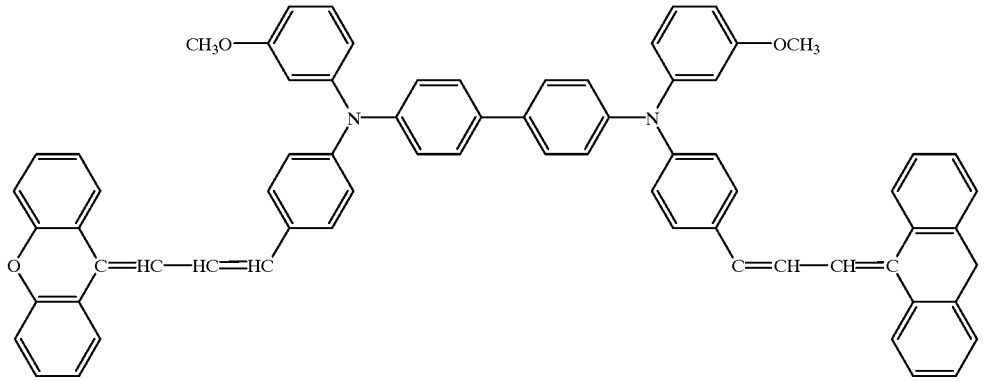

-continued
14
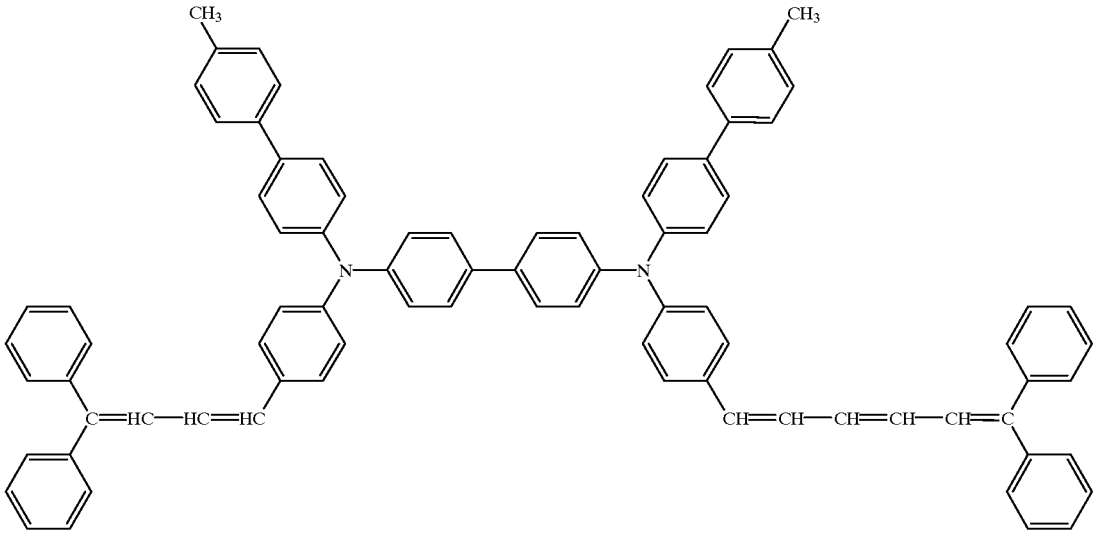
15
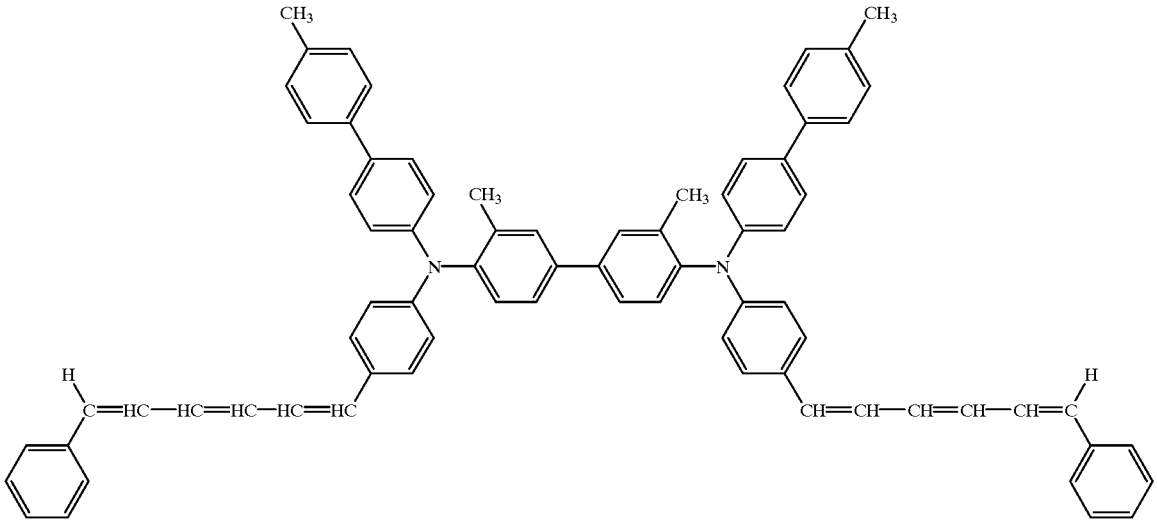
16
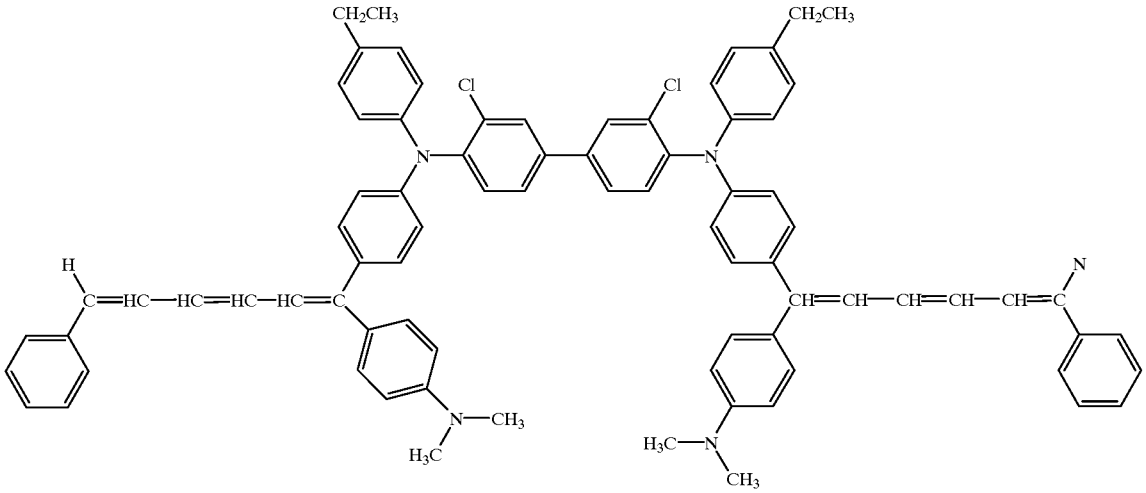

-continued
17
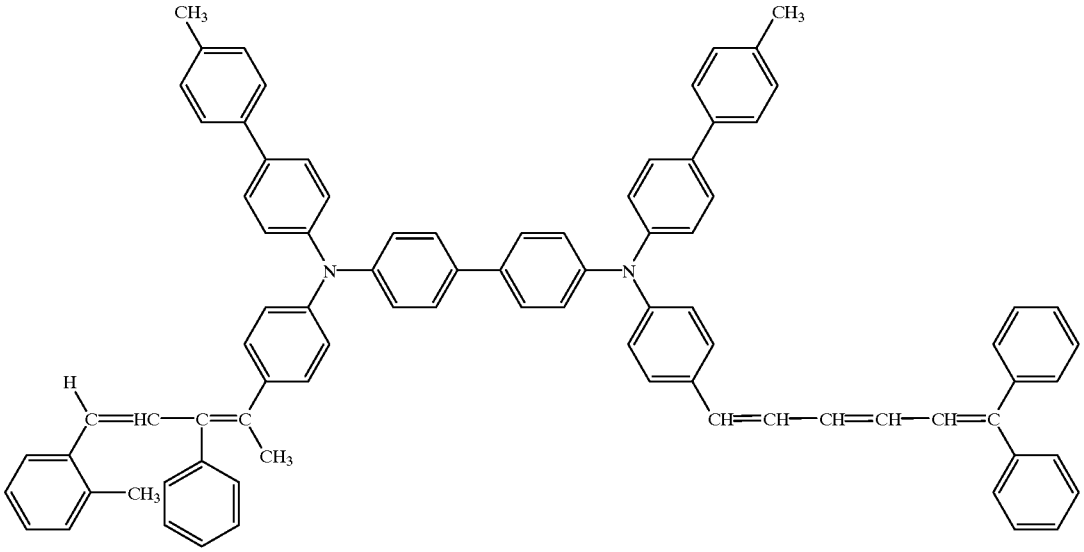
18
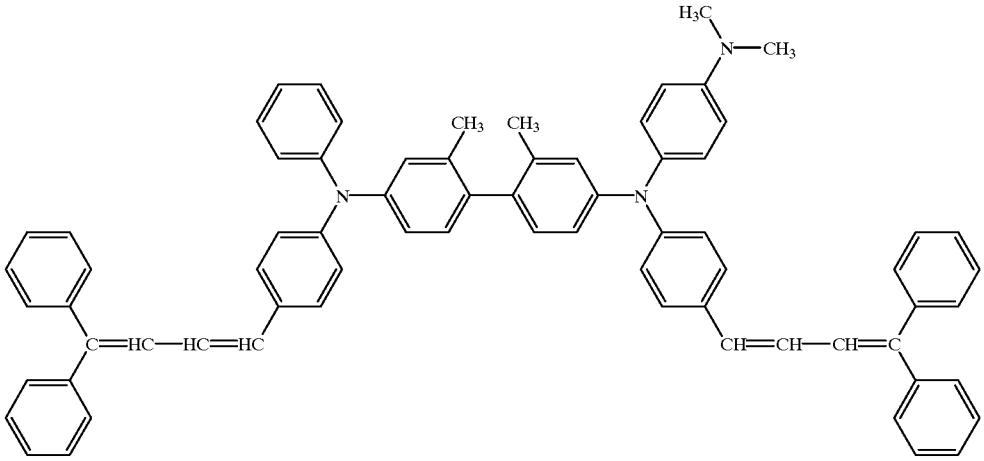
19
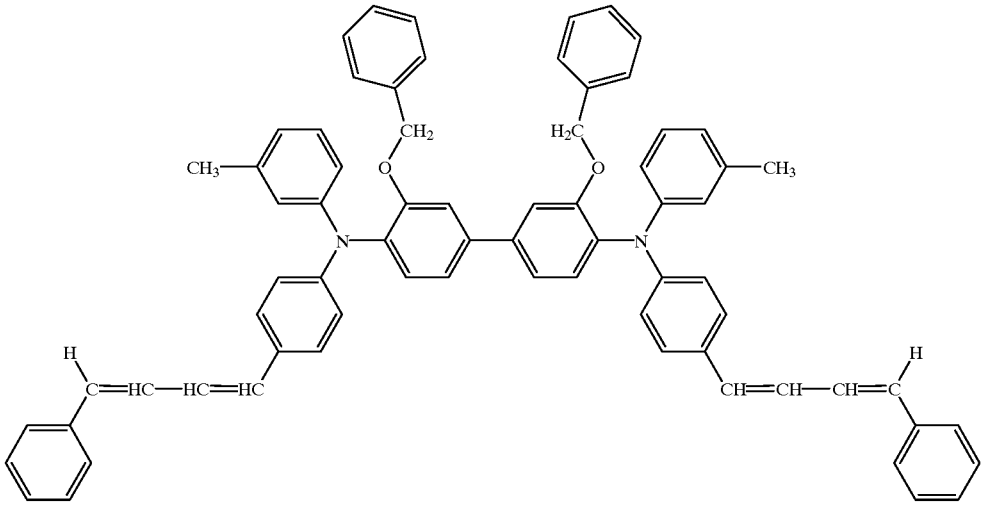

-continued
20
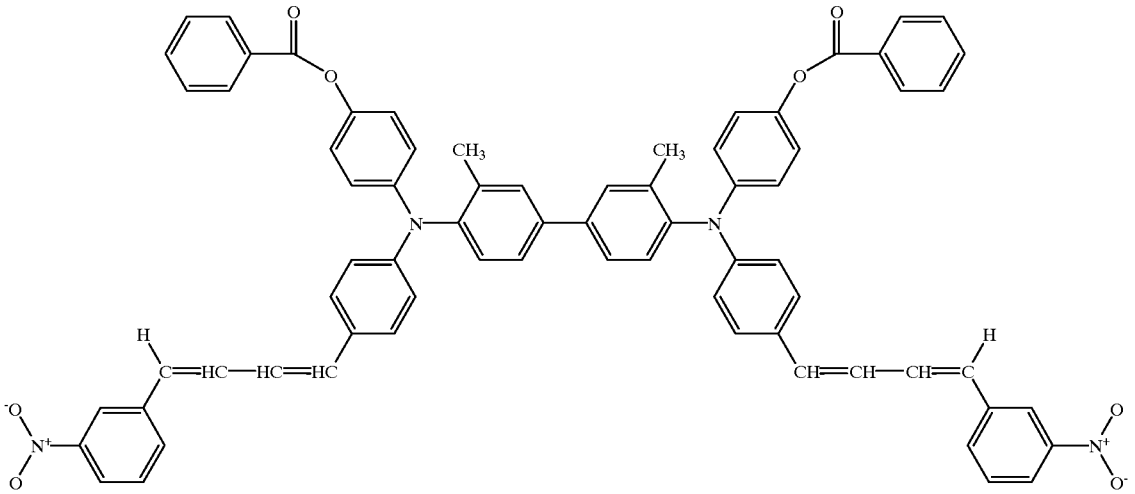
21
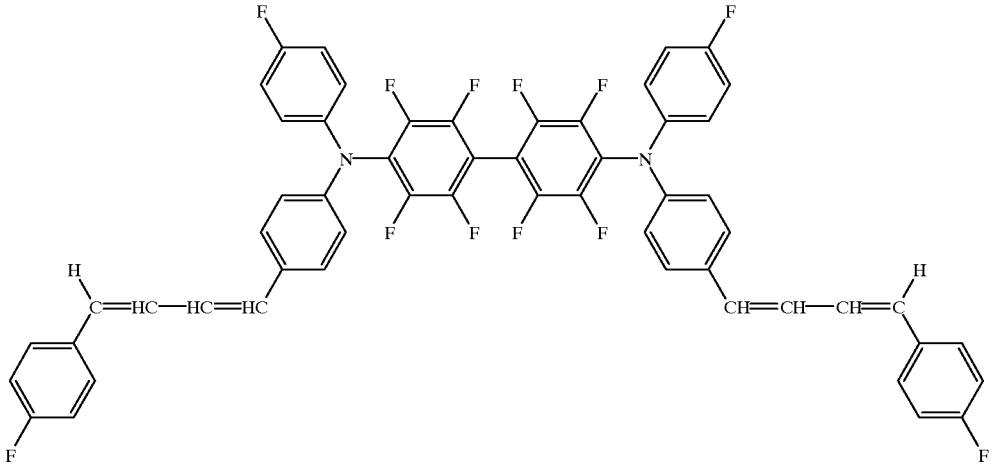
22
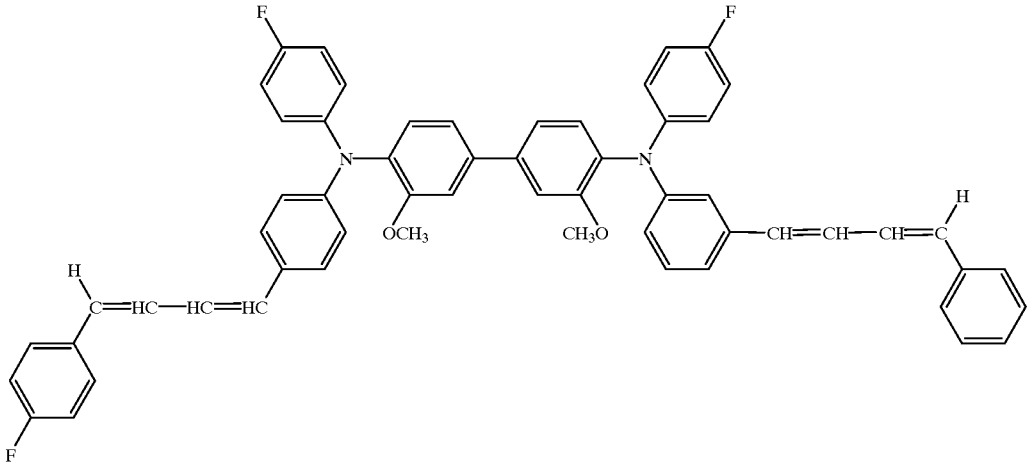

-continued
23
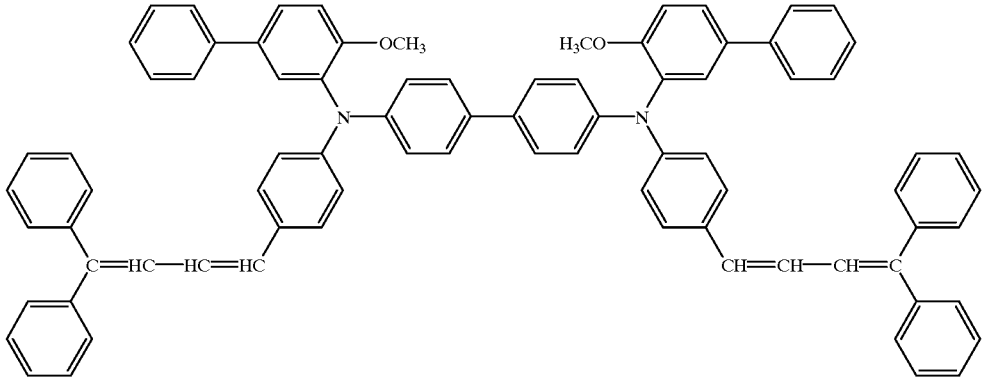
24
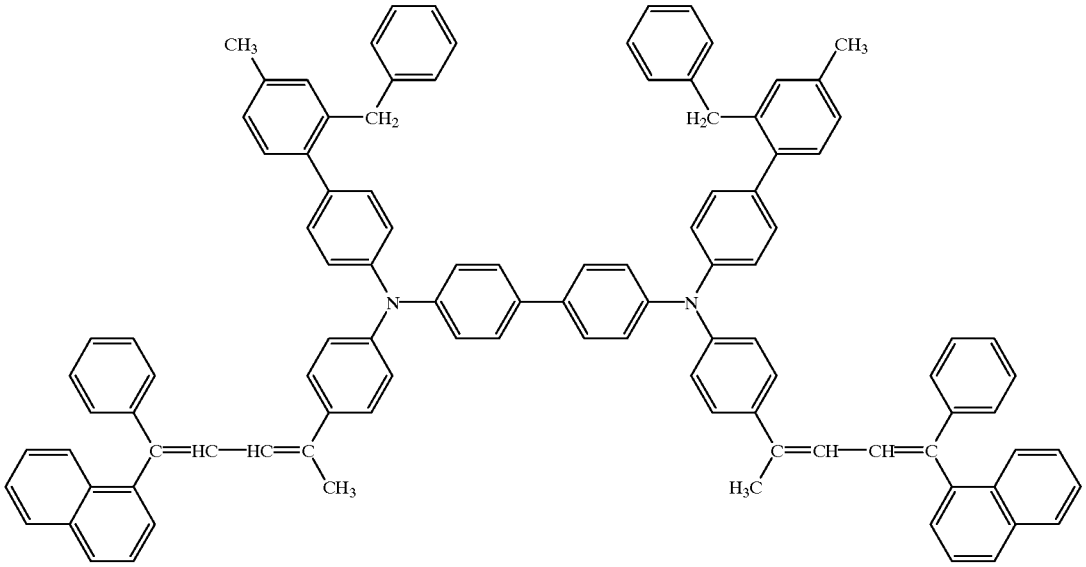
25
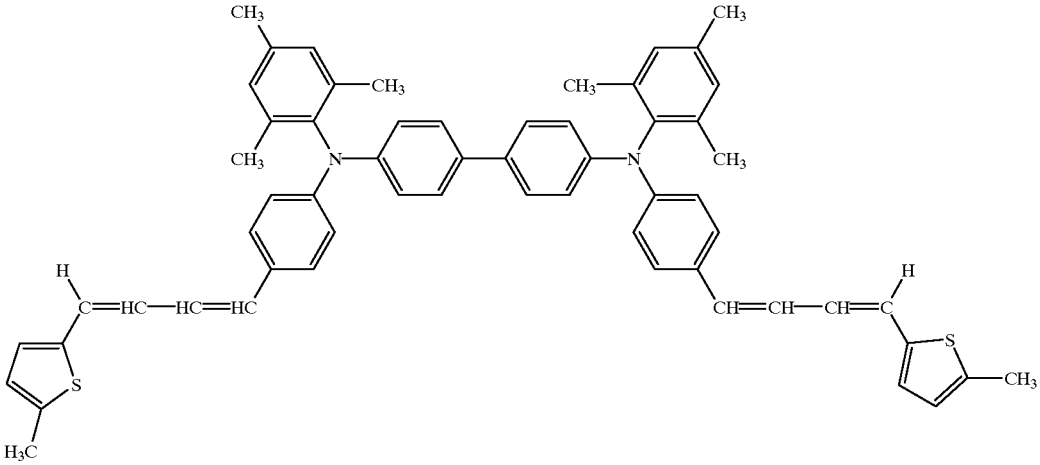

-continued
26
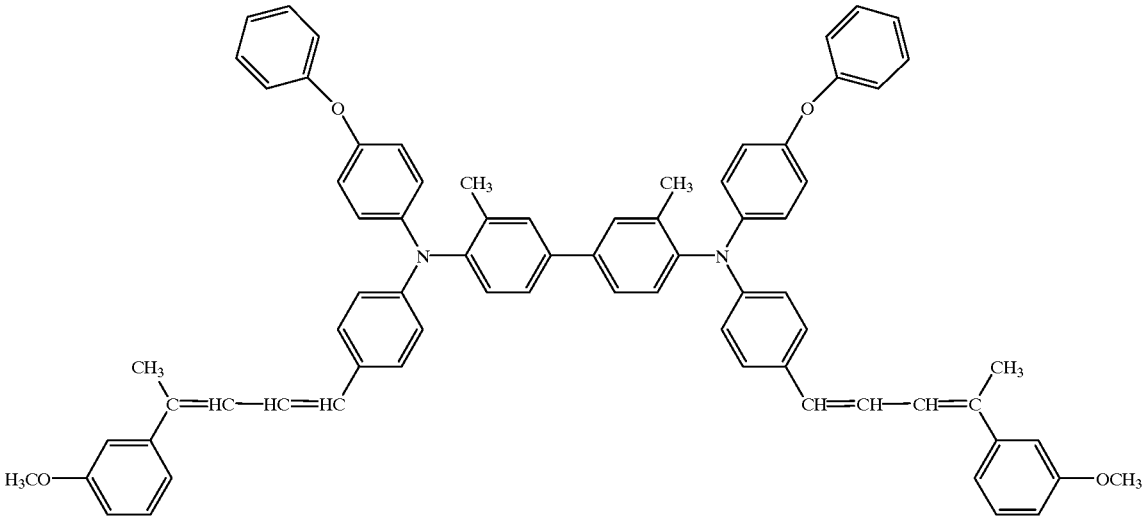
27
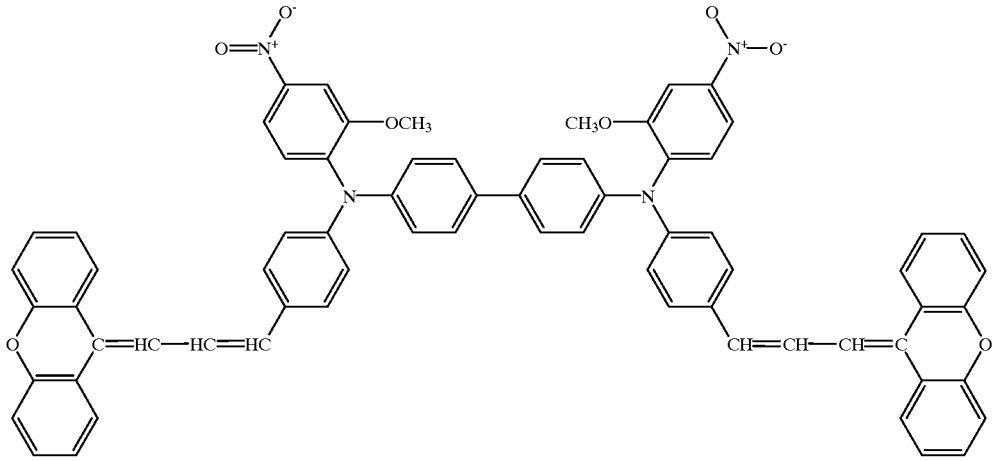
28
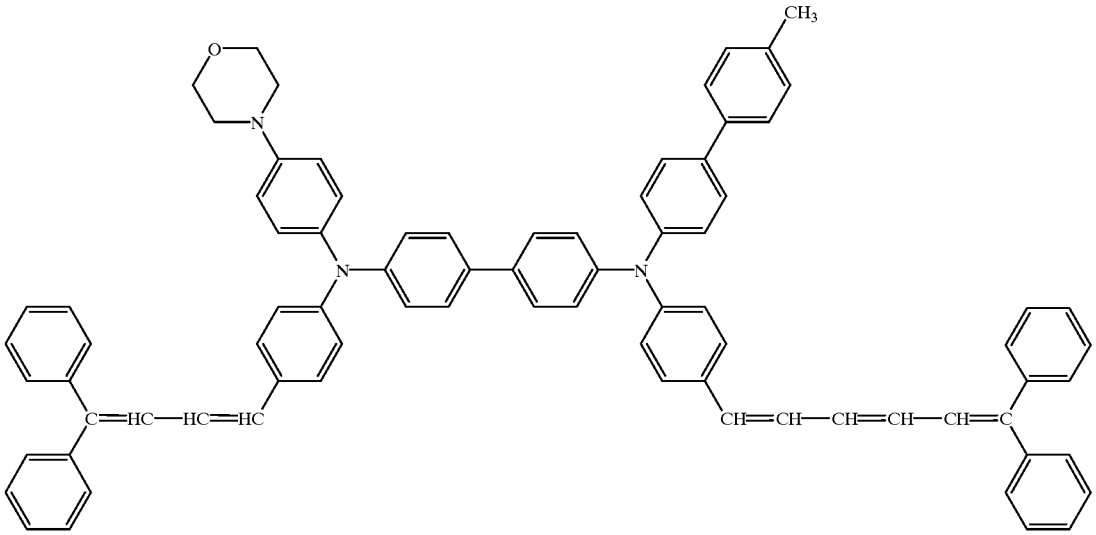

-continued
29
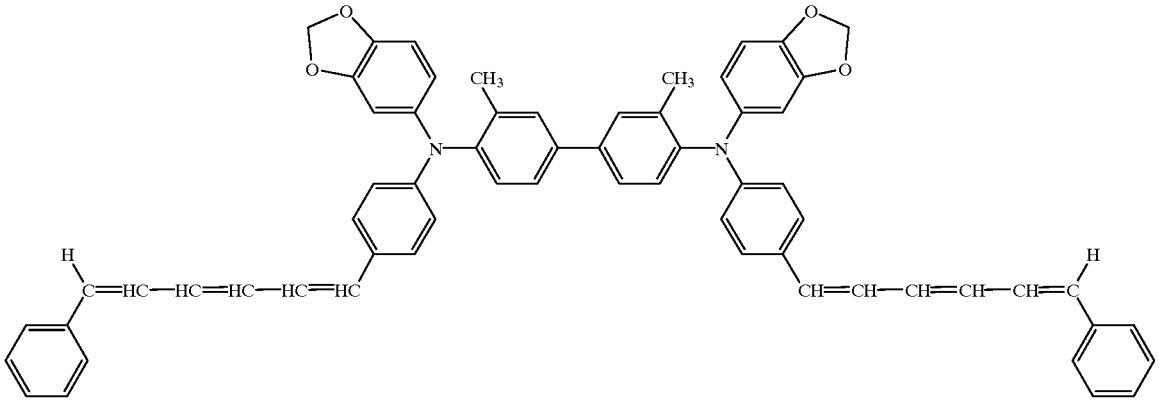
30
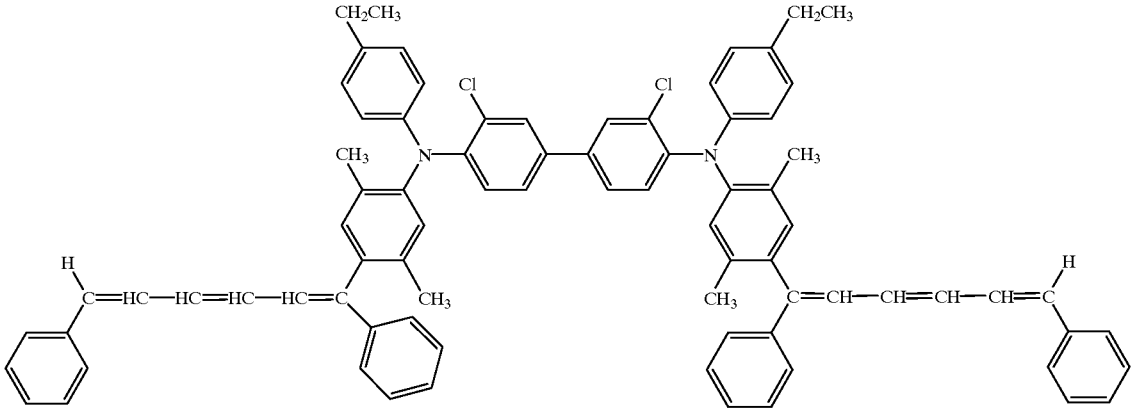
31
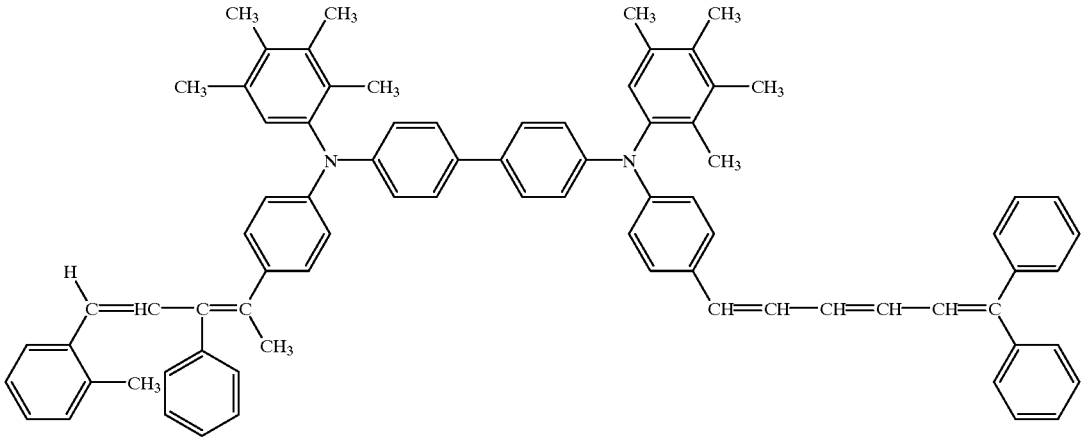

-continued
32
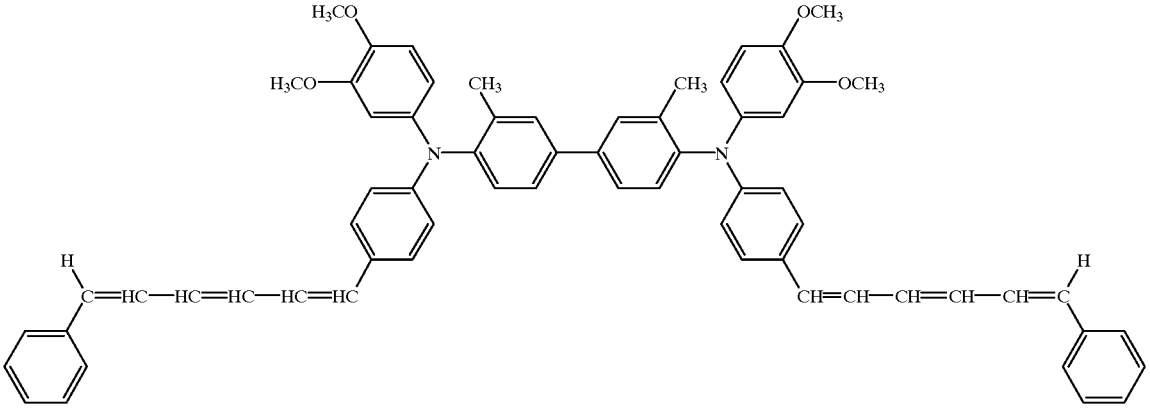
33
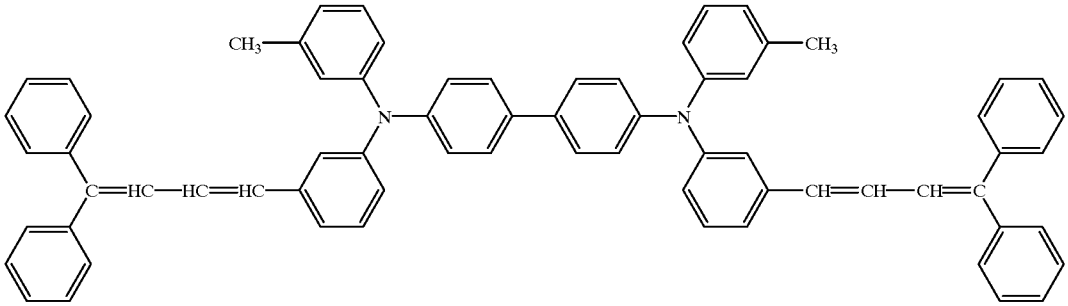
34
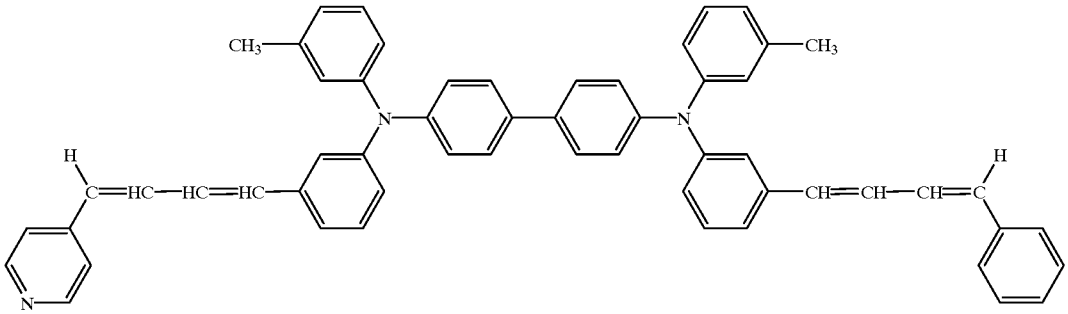
35
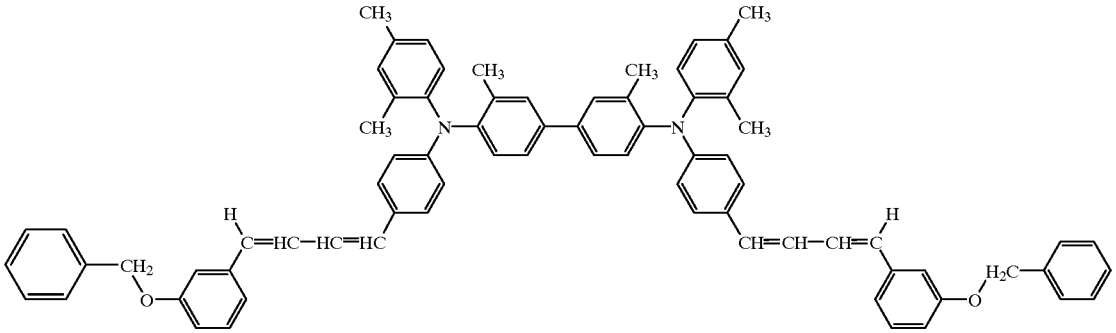

-continued
36
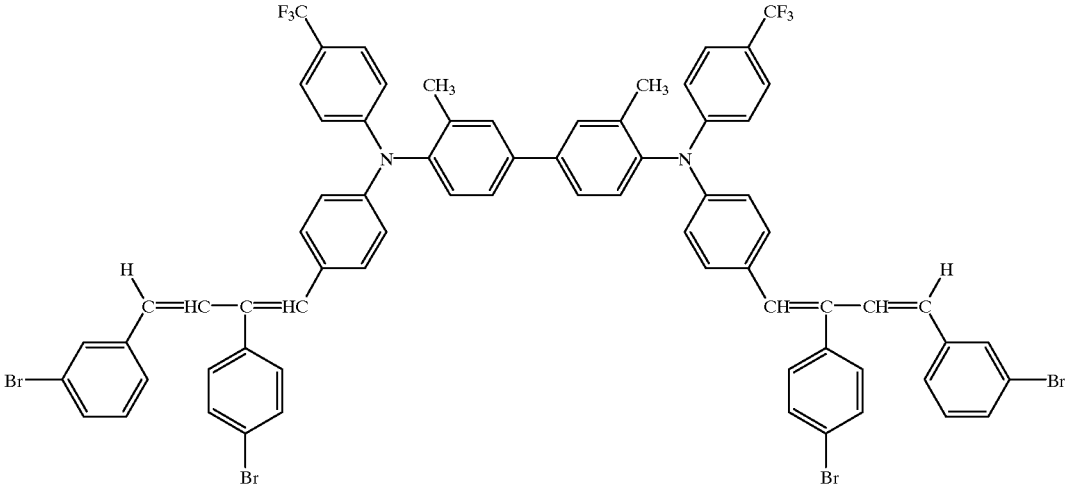
37
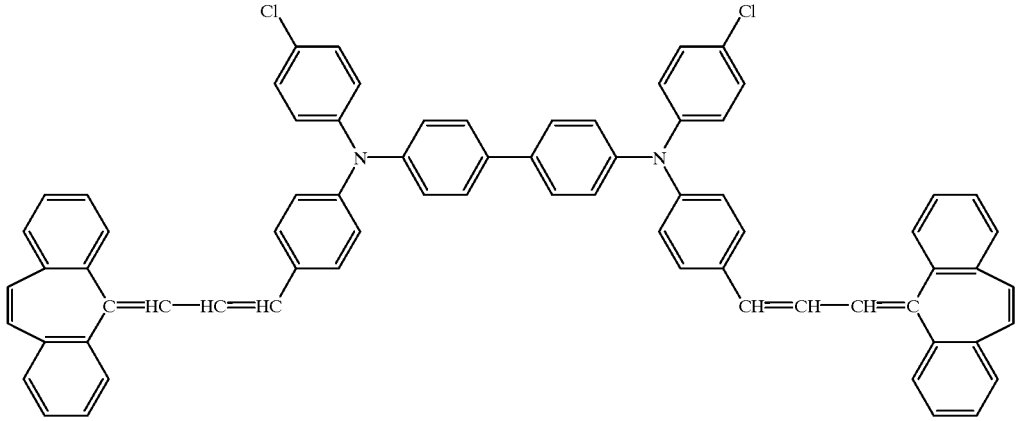
38
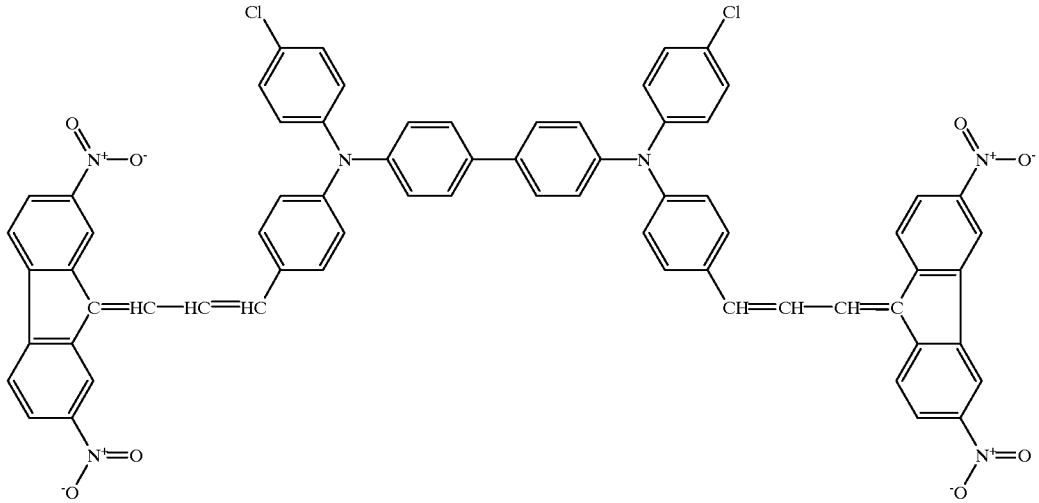

-continued
39
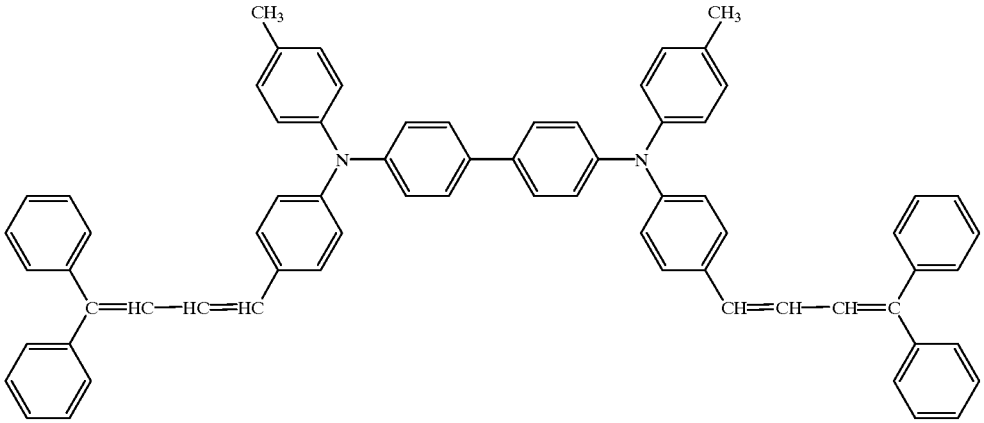
40
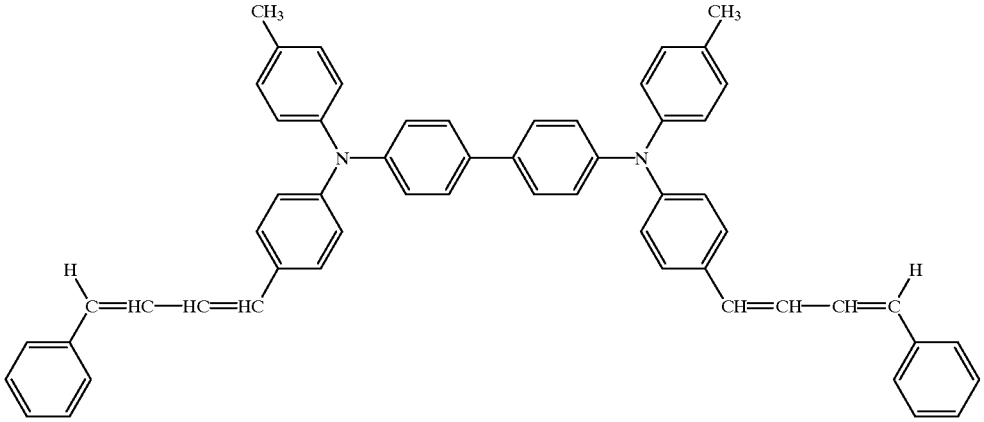
41
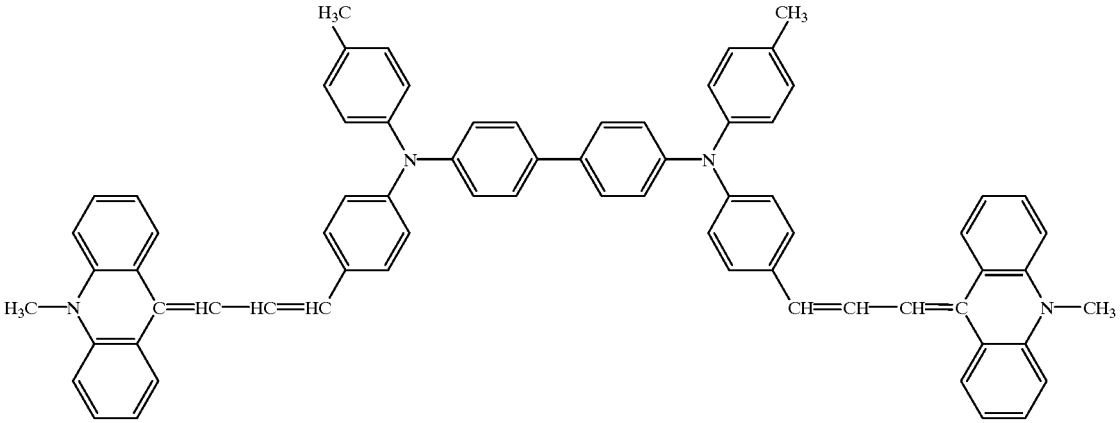
42
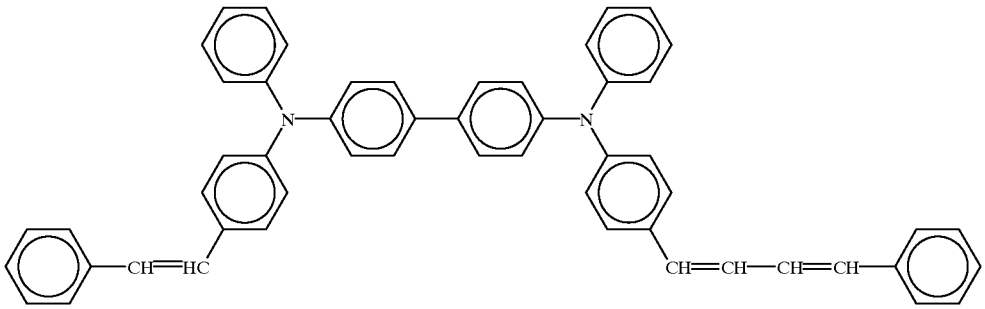

-continued

43

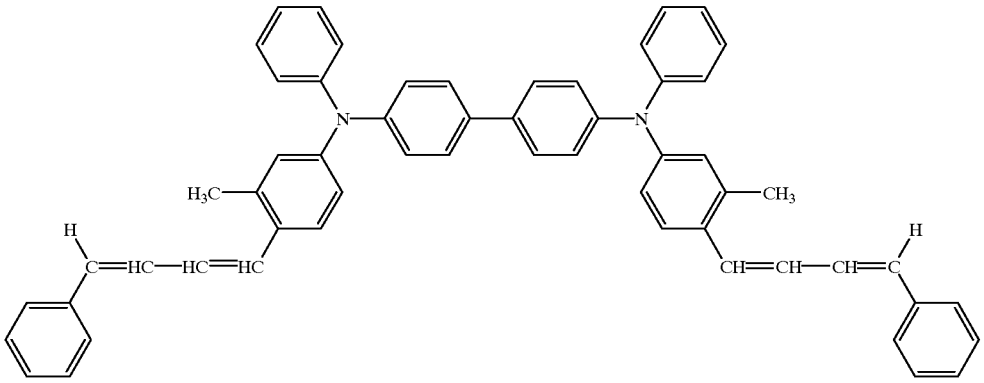

44

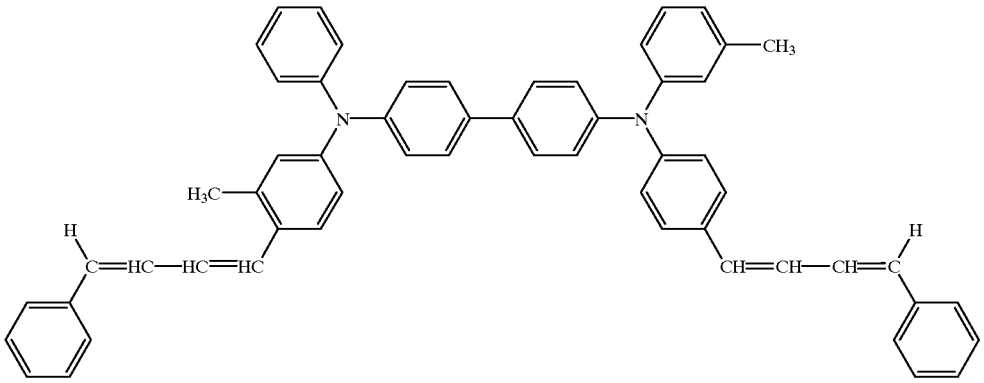

The arylamine type compound of the formula (1) may be prepared by a known method.

For example, a well known arylamine type compound can be used as a starting material, and is subjected to a well known carbonyl-introducing reaction and then to Wittig reaction to obtain the aimed compound. This method is further explained as illustrated below.

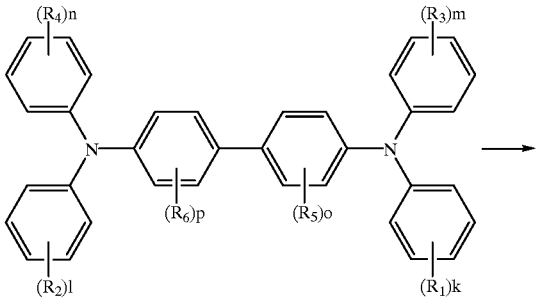

[3]

-continued

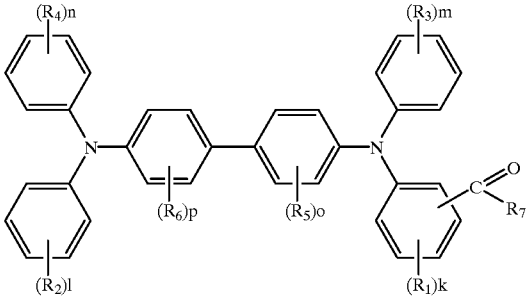

[4]

1) In case of $R_7$=H

An arylamine type compound of the formula (3) (in the formulas (3) and (4), $R_1$, $R_2$, $R_3$, $R_4$, $R_5$, $R_6$, $R_7$, $X_1$, $X_2$, k, l, m, n, o and p are as defined in the formula (1)) is reacted with a formylating agent such as N,N-dimethylformamide or N-methylformanilide in the presence of phosphorus oxychloride to obtain an aldehyde form of the formula (4). In this case, when the formylating agent is used in a large excess amount, it works also as a reaction solvent, but a solvent inert to the reaction, such as O-dichlorobenzene or benzene, may be used.

2) In case of $R_7 \neq H$

An arylamine type compound of the formula (3) is reacted with an acid chloride of the formula Cl—CO—$R_7$ in the presence of a Lewis acid such as aluminum chloride, iron chloride or zinc chloride in a solvent such as nitrobenzene, dichloromethane or carbon tetrachloride to obtain a ketone-form of the formula (4).

The above obtained aldehyde-form or ketone-form of the formula (4) is then reacted with a Wittig reagent at a temperature of from 10 to 200° C., preferably from 20 to 100° C., in the presence of a known base catalyst such as butyl lithium, phenyl lithium, sodium methoxide, sodium ethoxide or potassium t-butoxide in a well known organic solvent inert to the reaction, such as N,N-dimethylformamide, N,N-dimethylacetamide, tetrahydrofuran, dioxane, benzene or toluene, to obtain a compound of the formula (6), said Wittig reagent being obtained by reacting a halogen compound of the formula (5) (in the formula (5), $R_7$, $R_8$, $R_9$, $R_{10}$ and $R_{11}$ are as defined in the formula (2), and Q is a halogen atom such as a chlorine atom or a bromine atom) and a triphenylphosphine or by reacting said halogen compound and a trialkoxyphosphorus compound $(R_{12}O)_3P$ ($R_{12}$ is an alkyl group such as a methyl group or an ethyl group). In this case, any of a cis-form, a trans-form and a mixture of the cis-form and the trans-form can be obtained. (In the present invention, the formulas (1) and (6) represent any of a cis-form, a trans-form and a mixture of the cis-form and the trans-form.)

The compound of the formula (6) is further subjected to carbonyl-introducing reaction to prepare a compound of the formula (7), which is then subjected to such a Wittig reaction as defined above, to obtain an aimed compound (1).

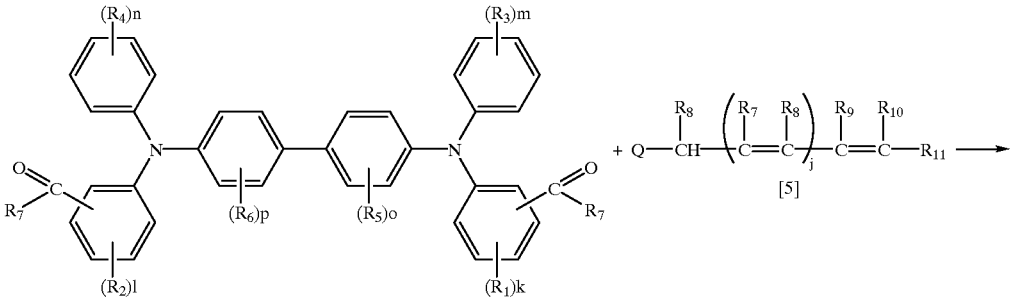

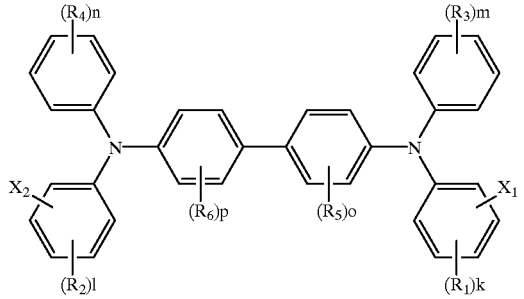

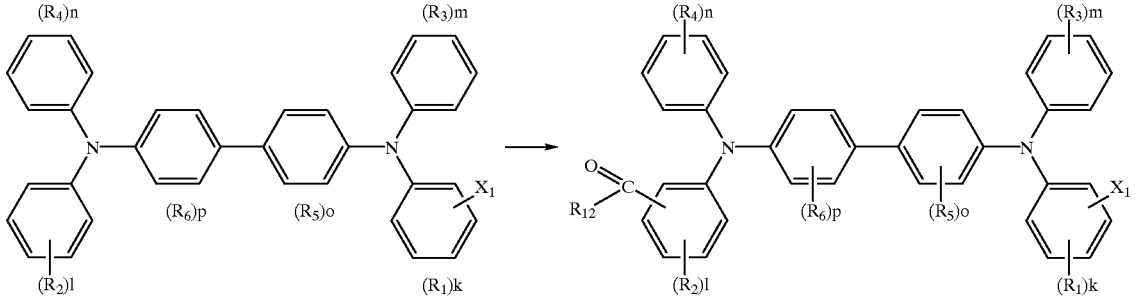

-continued

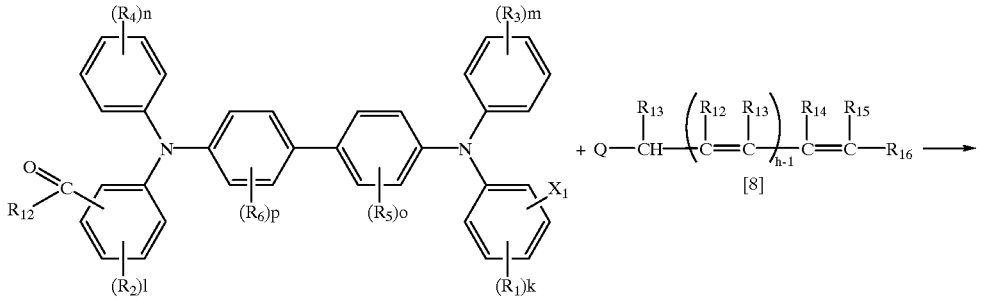

[7]

[8]

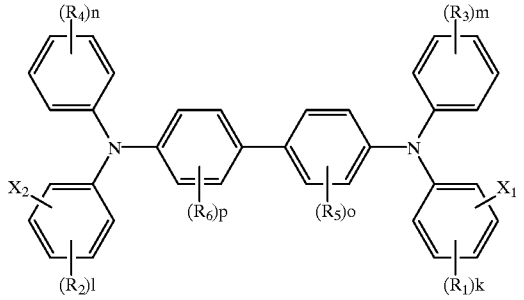

[1]

In these reactions, a highly pure product can be obtained by carrying out a well known purification step such as recrystallization purification, reprecipitation purification, sublimation purification or column purification after finishing each reaction step or after finishing all reaction steps.

The electrophotographic photoreceptor of the present invention has a photosensitive layer containing one or two or more arylamine type compounds of the formula (1).

The arylamine type compounds of the formula (1) achieve excellent properties as an organic photoconductive material. Particularly, when they are used as a charge-transporting material, they provides a photosensitive material having a high sensitivity and an excellent durability.

There are known various shapes of a photosensitive layer for an electrophotographic photoreceptor, but the photosensitive layer of the electrophotographic photoreceptor of the present invention can be formed into any of the known shapes.

The structure of the photosensitive layer (photoconductive layer) can be any of known type photosensitive layers such as a laminated type photosensitive layer prepared by laminating a charge-generating layer and a charge-transporting layer in this order or laminating these layers in reverse order, or a dispersion type photosensitive layer prepared by dispersing particles of a charge-generating material in a charge-transporting medium.

Examples of a photosensitive layer include a photosensitive layer obtained by adding an arylamine type compound and, if necessary, a coloring matter as a sensitizer and an electron-attractive compound into a binder resin, a photosensitive layer obtained by adding a light-absorbing charge-generating material (photoconductive particle) quite efficiently generating a charge carrier and an arylamine type compound into a binder resin, and a photosensitive layer obtained by laminating a charge-transporting layer comprising an arylamine type compound and a binder resin and a charge-generating layer comprising a charge-generating material quite efficiently generating a charge carrier when absorbing light or a mixture with a binder resin.

In addition to the arylamine compounds of the formula (1), these photosensitive layers may further contain an organic photoconductive material, particularly a compound having excellent properties as a charge-transporting material, such as other well-known arylamine compound, hydrazone compound or stilbenze compound.

In the present invention, when the arylamine type compound of the formula (1) is contained in a charge-transporting layer of a photosensitive layer comprising two layers of a charge-generating layer and a charge-transporting layer, there can be provided a photosensitive material having an excellent durability, a high sensitivity and a small residual potential and also have an advantage that variation of a surface potential, lowering of a sensitivity and accumulation of a residual potential are small even when repeatedly used.

Usually, a laminated type photosensitive material having a charge-transporting layer containing the arylamine type compound of the formula (1) as a charge-transporting material can be obtained by preparing a charge-generating layer by directly vapor-depositing a charge-generating material or coating a dispersion of a charge-generating material and a binder resin and thereafter by casting an organic solvent solution containing the arylamine type compound or coating a dispersion of the arylamine type compound and a binder resin thereon.

Also, a photosensitive material may be a mono-layer type photosensitive material obtained by coating a charge-generating material and a charge-transporting material dispersed and dissolved in a binder resin on an electroconductive substrate.

Examples of a charge-generating material include inorganic photoconductive particles such as selenium, selenium-tellurium alloy, selenium-arsenic alloy, cadmium sulfide or amorphous silicon; and organic photoconductive particles such as non-metallic phthalocyanine, metal-containing phthalocyanine, perynone type pigment, thioindigo, quinacridone, perylene type pigment, anthraquinone type pigment, azo type pigment; bisazo type pigment, trisazo type pigment, tetrakis type azo pigment or cyanine type pigment.

Further, various organic pigments or dyes such as polycyclic quinone, pyrylium salt, thiopyrylium salt, indigo, anthanthrone or pyranthrone, can be used. Among them, preferable examples include non-metallic phthalocyanine, phthalocyanines having metals, their oxides or chlorides such as copper, indium chloride, gallium chloride, tin, oxytitanium, zinc or vanadium coordinated, and azo pigments such as monoazo, bisazo, trisazo or polyazo pigments. Particularly, an azo pigment having a coupler component of the following formula (X) in the molecule is preferable.

(X)

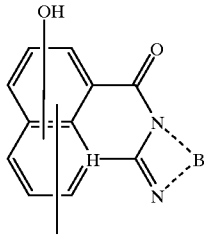

In the above formula (X), B is a bivalent aromatic hydrocarbon group or a bivalent heterocyclic group containing a nitrogen atom in the ring. Examples of the bivalent aromatic hydrocarbon group include a bivalent monocyclic aromatic hydrocarbon group such as an O-phenylene group and a bivalent condensed polycyclic aromatic hydrocarbon group such as an O-naphthylene group, a Peri-naphthylene group, a 1,2-anthraqiuinonylene group or a 9,10-phenanthrylene group.

Examples of the bivalent heterocyclic group containing a nitrogen atom in the ring include a bivalent 5- to 10-membered heterocyclic groups containing a nitrogen atom, preferably at most 2 nitrogen atoms, in the ring, such as a 3,4-pyrazole-di-yl group, a 2,3-pyridine-di-yl group, a 4,5-pyrimidine-di-yl group, a 6,7-indazole-di-yl group, a 5,6-benzimidazole-di-yl group or a 6,7-quinoline-di-yl group.

These bivalent aromatic hydrocarbon groups and bivalent heterocyclic groups having a nitrogen atom in the molecule may have a substituent. Examples of the substituent include an alkyl group such as a methyl group, an ethyl group, a n-propyl group, a i-propyl group, a n-butyl group, a i-butyl group or a n-hexyl group; an alkoxy group such as a methoxy group, an ethoxy group, a propoxy group or a butoxy group; a hydroxyl group; a nitro group; a cyano group; a halogen atom such as a fluorine atom, a chlorine atom, a bromine atom or an iodine atom; a carboxyl group; an alkoxycarbonyl group such as an ethoxycarbonyl group; a carbamoyl group; an aryloxy group such as a phenoxy group; an aralkoxy group such as a benzyloxy group; and an aryloxycarbonyl group such as a phenyloxycarbonyl group.

Also, a photosensitive material containing a metal-containing phthalocyanine is improved with respect to a sensitivity to a laser light. Particularly, a preferable example is an electrophotographic photoreceptor having a sensitive layer containing at least a charge-generating material and a charge-transporting material on an electroconductive substrate, wherein oxytitaniumphthalocyanine having the main diffraction peak of X-ray diffraction spectrum by CuKα-ray at a Bragg angle (2θ±0.2°) of 27.3° is used as the charge-generating material and the arylamine type compound of the formula (1) is used as the charge-transporting material.

The electrophotographic photoreceptor thus obtained has a high sensitivity, a low residual potential and a high chargeability and also having an advantage that variation by repeated use is small, and a charge stability having an influence on an image density is particularly satisfactory, thus providing a high durability. Also, the electrophotographic photoreceptor thus obtained has a high sensitivity in the wavelength zone of from 750 to 850 nm, and is therefore suitable for a semiconductor laser printer.

Oxytitaniumphthalocyanine used as a charge-generating material has the main diffraction peak of X-ray diffraction spectrum at a Bragg angle (2θ±0.2°) of 27.3°. "The main diffraction peak" means the strongest (highest) peak of strength of X-ray diffraction spectrum.

The powder X-ray spectrum of the oxytitaniumphthalocyanine used has the main diffraction peak at a Bragg angle (2θ±0.2°) of 27.3°, and other peaks are referred to hereinafter depending on particular conditions but there are other peaks at 9.5° and 24.1°.

A method for producing the oxytitaniumphthalocyanine is not specially limited, examples of which are illustrated below.

① A method for preparing (II) type crystal as described in Preparation Example 1 of JP-A-62-67094. That is, orthophthalodinitrile and titanium halide are reacted by heating in an inert organic solvent, and are then subjected to hydrolysis.

② Various crystal type oxytitaniumphthalocyanine is directly heat-treated with sulfuric acid or a sulfonated product of the formula R—$SO_3H$ (wherein R is an aliphatic or aromatic residue which may have a substituent) in an organic acid solvent, and may further be optionally heat-treated with a mixed solvent of an insoluble organic solvent and water.

③ If desired, the various crystal type oxytitaniumphthalocyanine is previously made amorphous by a well-known method, for example, by being dissolved in a concentrated sulfuric acid and then placed in ice water or by a mechanical grinding method using a paint shaker, a ball mill or a sand grind mill, and is then heat-treated with the above-mentioned sulfonated product or heat-treated with a mixed solvent of a water-insoluble organic solvent and water.

④ In the treatment with the above-mentioned sulfonated product, a mechanical grinding method using a paint shaker, a ball mill or a sand grind mill may be used in combination in place of the heat-treatment.

In the present invention, other oxytitaniumphthalocyanines can be used, examples of which include A type oxytitaniumphthalocyanine having strong diffraction peaks at Bragg angles (2θ±0.2°) of 9.3°, 13.2°, 26.2° and 27.1° and B type oxytitaniumphthalocyanine having strong diffraction peaks at Bragg angles (2θ±0.2°) of 7.6°, 22.5°, 25.5° and 28.6°.

In the present invention, if necessary, a dye or a coloring matter may be added. Examples of the dye and the coloring matter include a triphenylmethane dye such as Methyl Violet, Brilliant Green or Crystal Violet, a thiazine dye such as Methylene Blue, a quinone dye such as quinizarin, and a cyanine dye, and pyrylium salt, thiapyrylium salt, benzopyrylium salt and the like. Also, examples of an electron-attractive compound which forms a charge transfer complex with an arylamine type compound, include quinones such as chloranil, 2,3-dichloro-1,4-naphthoquinone, 1-nitroanthraquinone, 1-chloro-5-nitroanthraquinone, 2-chloroanthraquinone and phenanthrenequinone; aldehydes such as 4-nitrobenzaldehyde; ketones such as 9-benzoylanthracene, indandione, 3,5-dinitrobenzophenone, 2,4,7-trinitrofluorenone, 2,4,5,7-tetranitrofluorenone and 3,3',5,5'-tetranitrobenzophenone; acid anhydrides such as phthalic anhydride and 4-chloronaphthalic anhydride; cyano compounds such as tetracyanoethylene, terephthalalmalononitrile, 9-anthrylmethylidenemalononitrile, 4-nitrobenzalmalononitrile and 4-(p-nitrobenzoyloxy) benzalmalononitrile; and phthalides such as 3-benzalphthalide, 3-(α-cyano-p-nitrobenzal)phthalide and 3-(α-cyano-p-nitrobenzal)-4,5,6,7-tetrachlorophthalide.

A charge-generating layer in a laminated type photosensitive layer may be a dispersion layer containing fine particles of these materials dispersed in a binder resin such as polyester resin, polyvinyl acetate, polyester, polycarbonate, polyvinyl acetoacetal, polyvinyl propional, polyvinyl butyral, phenoxy resin, epoxy resin, urethane resin, cellulose ester or cellulose ether. Further examples of a binder resin include a polymer or copolymer of a vinyl compound such as styrene, vinyl acetate, vinyl chloride, acrylate, methacrylate, vinyl alcohol or ethyl vinyl ether, polyamide, silicone resin and the like. In this case, a charge-generating material is used in an amount of from 20 to 2,000 parts by weight, preferably from 30 to 500 parts by weight, more preferably from 33 to 500 parts by weight, to 100 parts by weight of a binder, and the thickness of the charge-generating layer is usually from 0.05 μm to 5 μm, preferably from 0.1 μm to 2 μm, more preferably from 0.15 μm to 0.8 μm. If necessary, the charge-generating layer may contain various additives such as a leveling agent to improve coating properties, an antioxidant and a sensitizer. Further, the charge-generating layer may be a vapor-deposited film of the above charge-generating materials.

In the case of a dispersion type photosensitive layer, a charge-generating material is required to be a particle of sufficiently small particle size, and the particles size is preferably at most 1 μm, more preferably at most 0.5 μm. The amount of the charge-generating material to be dispersed in a photosensitive layer is, for example, in the range of from 0.5 to 50 wt %, preferably from 1 to 20 wt %, and if the amount of the charge-generating material is too small, a satisfactory sensitivity can not be obtained, while if the amount of the charge-generating material is too large, various inconveniences such as lowering of chargeability and lowering of sensitivity are caused.

The thickness of the dispersion type photosensitive layer is usually from 5 to 50 μm, preferably from 10 to 45 μm. In this case, the dispersion type photosensitive layer may further contain a well-known plasticizer for improving film-formability, flexibility and mechanical strength, and an additive for controlling a residual potential, a dispersion aid for improving dispersion stability, a leveling agent for improving coating property, a surfactant, for example silicone oil, fluorine type oil, and other additives.

Further, the photosensitive layer of the electrophotographic photoreceptor of the present invention may contain a well-known plasticizer for improving film formability, flexibility and mechanical strength. Examples of the plasticizer to be added to the above coating solution include phthalate, phosphate, epoxy compound, chlorinated paraffin, chlorinated aliphatic acid ester, and an aromatic compound such as methylnaphthalene. The coating solution containing an arylamine type compound as a charge-transporting material in a charge-transporting layer may have the above-mentioned composition, but photoconductive particles, a dye coloring matter, an electron-attractive compound and the like may be removed or they may be added in a small amount. In this case, a charge-generating layer may be a thin layer obtained by coating and drying a coating solution containing the above photoconductive particles and, if necessary, other organic photoconductive materials, a dye coloring matter, an electron-attractive compound or the like dissolved or dispersed in a binder resin or the like, or a layer obtained by vapor-depositing the above photoconductive particles.

If necessary, the photosensitive material thus obtained may further have a protective layer, a transparent insulating layer or an intermediate layer such as a barrier layer, an adhesive layer or a blocking layer as a layer for improving electric properties and mechanical properties. An electroconductive substrate, on which a photosensitive layer is formed, may be any one used in a well-known electrophotographic photoreceptor. Examples of the substrate include a drum or a sheet of a metal material such as aluminum, stainless steel, copper, nickel and the like, or a laminated material of a metal foil of these metals, a vapor-deposited material, a polyester film, the surface of which is provided with an electroconductive layer such as aluminum, copper, vanadium, tin oxide or indium oxide, and an insulating substrate such as paper. Further examples of the substrate include electroconductively treated plastic film, plastic drum, paper, paper tube and the like, which are obtained by coating an electroconductive material such as metal powder, carbon black, copper iodide or a high molecular electrolyte, together with an appropriate binder resin. Still further examples of the substrate include a plastic sheet or drum which is made electroconductive by incorporating an electroconductive material such as metal powder, carbon black, carbon fiber or the like. Also, there may be illustrated a plastic film or belt electroconductively treated with an electroconductive metal oxide such as tin oxide, indium oxide or the like.

Among them, a preferable substrate is a metal endless pipe such as aluminum.

Examples of a barrier layer and an intermediate layer include an inorganic layer of anodized aluminum film, aluminum oxide, aluminum hydroxide or the like, and an organic layer of polyvinyl alcohol, casein, polyvinylpyrrolidone, polyacrylic acid, celluloses, gelatin, starch, polyurethane, polyimide, polyamide or the like.

The electrophotographic photoreceptor of the present invention can be obtained in accordance with an ordinary method by coating a coating solution prepared by dissolving the arylamine type compound of the formula (1) in an appropriate solvent together with a binder resin and optionally further adding an appropriate charge-generating material, a sensitizing dye, an electron-attractive compound, other charge-transporting material, a plasticizer, a pigment or other well-known additives, on an electroconductive substrate, and then drying to form a photosensitive layer having a thickness of from a few microns to a few tens microns, preferably from to 45 μm, more preferably at least 27 μm. When the photosensitive layer comprises two layers of a charge-generating layer and a charge-transporting layer, the electrophotographic photoreceptor can be prepared by coating the above coating solution on a charge-generating layer or by forming a charge-generating layer on a charge-transporting layer obtained by coating the above coating solution.

Examples of a solvent used for preparing a coating solution include ethers such as tetrahydrofuran or 1,4-dioxane; ketones such as methyl ethyl ketone or cyclohexanone; aromatic hydrocarbons such as toluene or xylene; aprotic polar solvent such as N,N-dimethylformamide, acetonitrile, N-methylpyrrolidone or dimethylsulfoxide, esters such as ethyl acetate, methyl formate or methylcellosolve acetate; and other solvents such as dichloroethane or chloroform which can dissolve the arylamine type compound. As a matter of fact, among them, a solvent which can dissolve a binder resin, is selected.

A binder resin used in a charge-transporting layer in a laminated type photosensitive layer or a binder resin used as a matrix in a dispersion type photosensitive layer is preferably a polymer which is well compatible with a charge-transporting material and does not cause crystallization of the charge-transporting material after forming a film and which does not cause phase separation. Examples of the binder include a polymer and a copolymer of a vinyl compound such as styrene, vinyl acetate, vinyl chloride, acrylate, methacrylate or butadiene, and other various polymers such as polyvinyl acetal, polycarbonate, polyester, polyester carbonate, polysulfone, polyimide, polyphenylene oxide, polyurethane, cellulose ester, cellulose ether, phenoxy resin, silicone resin or epoxy resin, or their partly crosslinking-cured material. An amount of the binder resin is usually from 0.5 to 30 times by weight, preferably from 0.7 to 10 times by weight of an arylamine type compound.

A charge-transporting layer in a laminated type photosensitive layer may optionally contain an antioxidant, a sensitizer and other various additives and other charge-transporting material. The thickness of a charge-transporting material is usually from 10 to 60 $\mu$m, preferably from 10 to 45 $\mu$m, more preferably from 27 to 40 $\mu$m. As an uppermost surface layer, there may be provided an overcoat layer mainly comprising a conventionally known thermoplastic or thermosetting polymer. Usually, a charge-transporting layer is formed on a charge-generating layer, but the reverse order may be possible. Each layer may be formed in accordance with a well-known method by coating a coating solution prepared by dissolving or dispersing a material to be contained in the layer in an appropriate order. In addition to these components, a charge-transporting layer may further contain various additives to improve mechanical strength or durability of a coating film.

Examples of these additives include well-known plasticizers, various stabilizers, fluidity-imparting agents, crosslinking agents and the like.

Examples of a coating method of a photosensitive layer include a spray coating method, a spiral coating method, a ring coating method, a dip coating method and the like.

Examples of the spray coating method include air spray, airless spray, electrostatic air spray, electrostatic airless spray, rotation-atomization type electrostatic spray, hot spray, hot airless spray or the like. In order to achieve a small particle size and a high deposition efficiency for obtaining a uniform coating thickness, the rotation-atomization type electrostatic spray method, particularly such a conveying method as disclosed in JP-A1-1-805198, is preferable, and thus, an electrophotographic photoreceptor having an excellent uniformity in thickness can be obtained at a generally high deposition efficiency by continuously conveying in the axial direction without causing a gap by rotating a cylindrical work.

Examples of the spiral coating method include a method of using a curtain-coating solution or a pouring-coating machine as disclosed in JP-A-52-119651, a method of continuously splashing a paint stream-likely through a very small opening as disclosed in JP-A-1-231966, a method of using a multinozzle body as disclosed in JP-A-3-193161, and the like.

Further, the dip coating method is explained hereinafter.

By using the arylamine type compound of the formula (1), a binder resin, a solvent and the like, a coating solution for forming a charge-transporting layer is prepared so as to have a total solid content concentration of preferably from 25 to 40% and a viscosity of from 50 to 300 centipoises, preferably from 100 to 200 centipoises. The viscosity of the coating solution is determined substantially by the type and molecular weight of a binder resin used, but if the molecular weight of the binder resin is too small, the mechanical strength of the polymer itself is lowered and it is therefore preferable to use a binder resin having an appropriate molecular weight which does not cause the above-mentioned disadvantage. By using the coating solution thus prepared, a charge-transporting layer is formed by means of the dip coating method.

Thereafter, the coating film is dried, and drying temperature and time are appropriately adjusted so as to achieve a sufficient drying. The drying temperature is usually from 100 to 250° C., preferably from 110 to 170° C., more preferably from 120 to 140° C. The drying can be carried out by using a hot air dryer, a vapor dryer, an infrared ray dryer, a far infrared ray dryer or the like.

EXAMPLES

Now, the present invention will be described in further detail with reference to Examples. However, it should be understood that the present invention is by no means restricted to such specific Examples. In Examples, "part" means "part by weight".

PREPARATION EXAMPLE

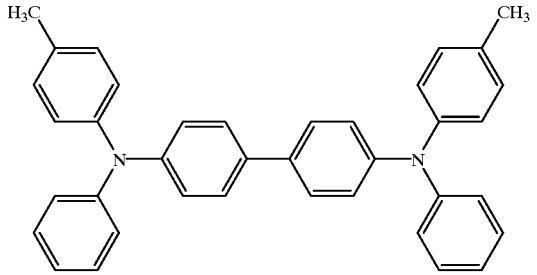

10 g of a compound of the above formula is dissolved in 40 ml of dimethylformamide, and 8.9 g of phosphorus oxychloride heated to 40° C. was dropwise added thereto (heat generation: 40 to 70° C.). The resultant reaction solution was stirred for 3 hours while controlling at 70±5° C. After cooling to 40° C. by allowing to stand, the reaction solution was placed in NaOH aqueous solution (water 100 ml, ice 50 g, NaOH 10 g) little by little. A solid obtained by filtration was washed with 10 ml of water for 2 times, and was further washed with 30 ml of methanol to obtain 9.1 g (82%) of a yellow solid bisformyl compound of the following structural formula.

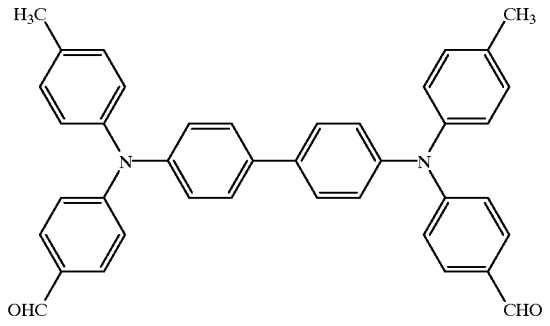

4 g of the bisformyl compound thus obtained and 9.6 g of cinnamyltriphenylphosphonium bromide were dissolved in 50 ml of tetrahydrofuran. While maintaining the resultant solution at 20±5° C., 1.7 g of sodium methylate was added thereto little by little (heat generation). After stirring for 2 hours, 30 ml of desalted water was added, and the resultant solution was subjected to purification treatment in accordance with an ordinary method to obtain 3.1 g (57%) of a yellow solid.

Figure 2:
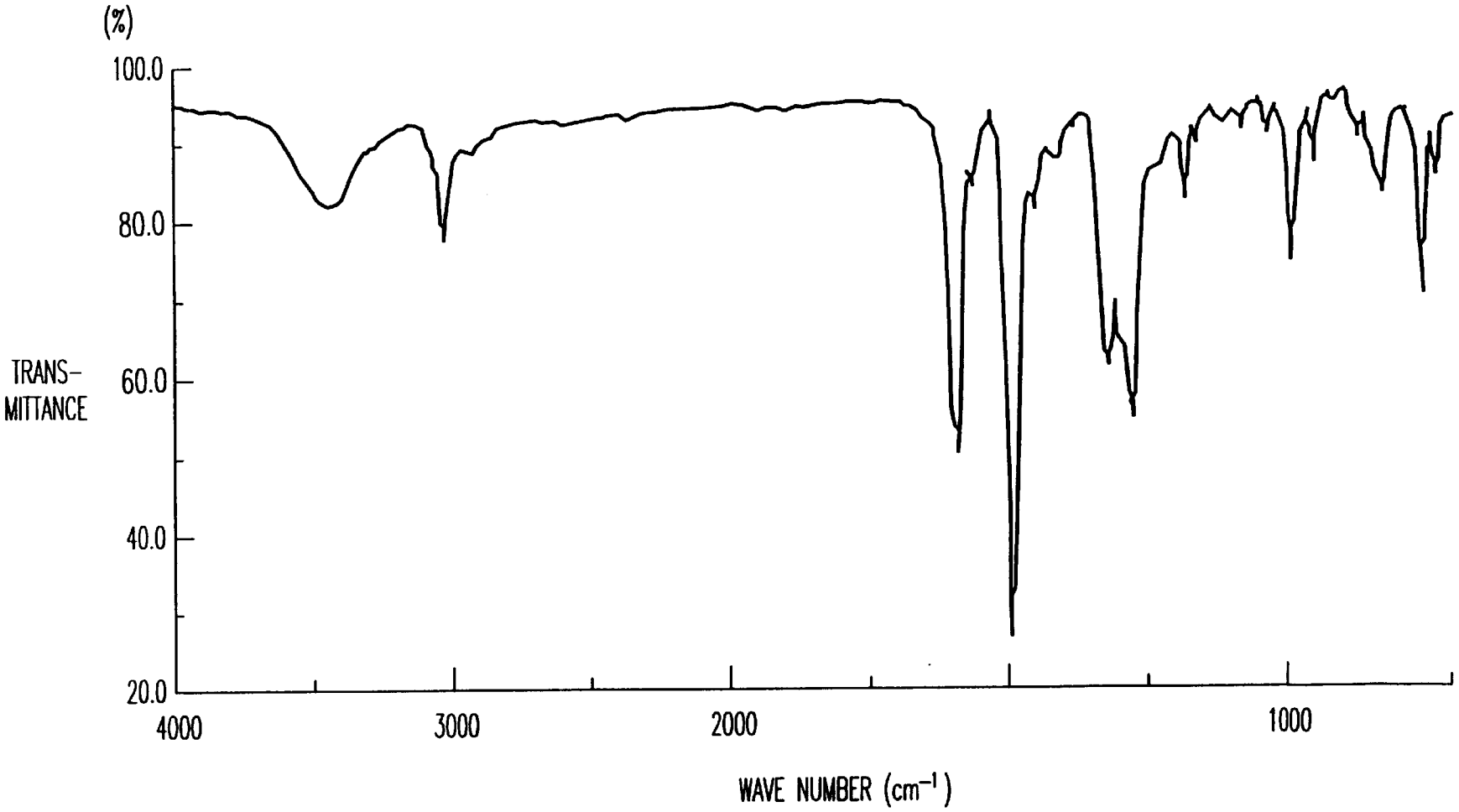

According to the following elemental analysis values and infrared absorption spectrum (FIG. 2), this compound was proved to be an arylamine type compound slaving the structural formula of compound No. 40.

| (Elemental analysis value) as $C_{58}H_{48}N_2$ | C (%) | H (%) | N (%) |
|---|---|---|---|
| Calculated value | 90.11 | 6.26 | 3.63 |
| Measured value | 90.02 | 6.47 | 3.50 |
| (Result of mass spectrometric analysis) as $C_{58}H_{48}N_2$ | | | |
| Mw = 773 | | | |
| $Mw^+$ = 773 | | | |

EXAMPLE 1

1.0 part of titaniumoxyphthalocyanine pigment having strong diffraction peaks at Bragg angles (2θ±0.2°) of 9.3°, 10.6°, 13.2°, 15.1°, 15.7°, 16.1°, 20.8°, 23.3° and 27.1° in X-ray diffraction spectrum was added to 14 parts of dimethoxyethane, and the resultant mixture was subjected to dispersion treatment by a sand grinder. Thereafter, 14 parts of dimethoxyethane and 14 parts of 4-methoxy-4-methylpentanone-2 were added to dilute the mixture, and the mixture was further mixed with a solution prepared by dissolving 0.5 part of polyvinyl butyral (tradename: Denka Butyral #6000-C manufactured by Denki Kagaku Kogyo K.K.) and 0.5 part of phenoxy resin (tradename: UCAR (registered tradename) PKHH manufactured by Union Carbide Co.) in a mixed solution of 6 parts of dimethoxyethane and 6 parts of 4-methoxy-4-methylpentanone-2 to obtain a dispersion. The dispersion thus obtained was coated by a wire bar on an aluminum layer vapor-deposited on a polyester film having a thickness of 75μm in such an amount as to be a dry weight of 0.4 g/m$^2$, and was dried to form a charge-generating layer.

The charge-generating layer thus formed was further coated with a coating solution prepared by dissolving 70 parts of the arylamine type compound prepared in the above Preparation Example and 100 parts of polycarbonate resin of the following formula in 900 parts of tetrahydrofuran, and was dried to form a charge-transporting layer having a thickness of 17 μm.

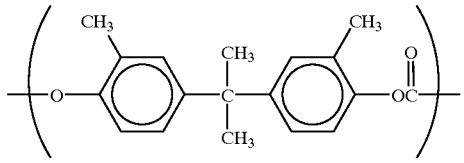

A sensitivity, i.e. half decay light-exposure amount of an electrophotographic photoreceptor having a photosensitive layer comprising the above prepared two layers, was 0.46 μJ/cm$^2$. The half decay light-exposure amount was determined by negatively charge the electrophotographic photoreceptor with a corona electric current of 50 μA in the dark, exposing the electrophotographic photoreceptor to light of 780 nm (exposure energy: 10 μW/cm$^2$) obtained by passing 20 lux white light through an interference filter and measuring the light-exposure amount required to decay a surface potential from −450 V to −225 V. Further, a surface potential at a exposure time of 9.9 seconds was measured as a residual potential, and this value was −2 V. This operation was repeated 2,000 times, but a rise of a residual potential was not recognized.

Further, a hole drift mobility of a charge (hole)-transporting layer was measured at 294 K (±1 K) in accordance with TOF method. This result is shown in FIG. 1 wherein the axis of abscissas indicates electric field and the axis of ordinates indicates a hole drift mobility.

EXAMPLE 2

An electrophotographic photoreceptor was prepared in the same manner as in Example 1, except that a titaniumoxyphthalocyanine pigment having strong diffraction peaks at Bragg angles (2θ±0.2°) of 9.5°, 27.1° and 27.3° in X-ray diffraction spectrum was used in place of the titaniumoxyphthalocyanine pigment used in Example 1. The electrophotographic photoreceptor thus obtained was exposed to light of 780 nm to measure a half decay light-exposure amount, and the measured half decay light exposure amount was 0.12 μJ/cm$^2$ and a residual potential was −16 V.

EXAMPLE 3

An electrophotographic photoreceptor was prepared in the same manner as in Example 1, except that a naphthalic acid type bisazo pigment of the following structural formula was used in place of the phthalocyanine type pigment used in Example 1. The electrophotographic photoreceptor thus obtained was exposed to white light to measure a half decay light-exposure amount, and the measured half decay light-exposure amount was 0.48 lux.sec and a residual potential was −10 V.

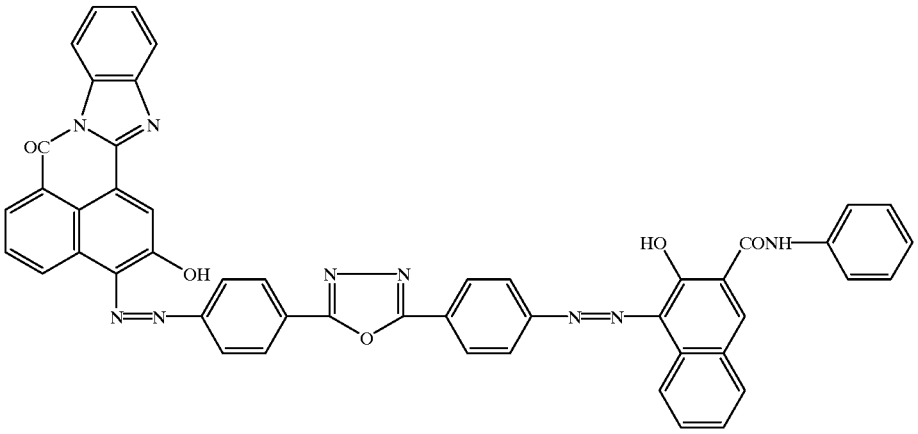

EXAMPLE 4

An electrophotographic photoreceptor was prepared in the same manner as in Example 1, except that a naphthalic acid type bisazo pigment of the following structural formula was used in place of the phthalocyanine type pigment used in Example 1, and was exposed to white light to measure a half decay light-exposure amount. As this result, the half decay light-exposure amount was 0.67 lux.sec and a residual potential was −2 V.

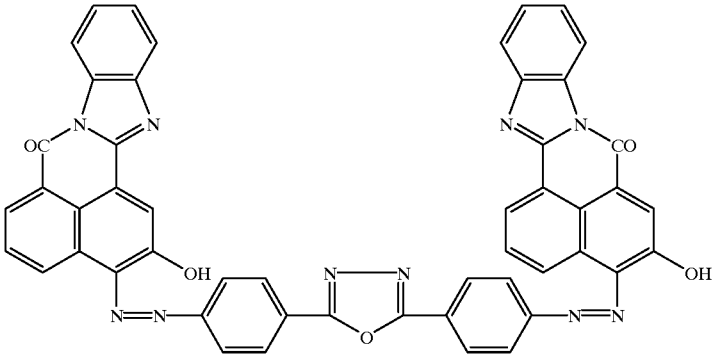

EXAMPLES 5 to 10

Electrophotographic photoreceptors were prepared in the same manner as in Example 1, except that various arylamine type compounds disclosed in the following Table 1 prepared in the same manner as in the above Preparation Example were used in place of the arylamine type compound used in Example 1, and were measured with respect to sensitivities and residual potentials, the measured values of which are shown in the following Table 1.

TABLE 1

| Example | Compound No. | Sensitivity ($\mu$J/cm$^2$) | Residual potential (V) |
|---|---|---|---|
| 5 | 4 | 0.47 | −3 |
| 6 | 6 | 0.48 | −2 |
| 7 | 7 | 0.57 | −18 |
| 8 | 8 | 0.60 | −23 |

TABLE 1-continued

| Example | Compound No. | Sensitivity ($\mu$J/cm$^2$) | Residual potential (V) |
|---|---|---|---|
| 9 | 14 | 0.48 | −4 |
| 10 | 42 | 0.48 | −4 |

EXAMPLES 11 to 15

Electrophotographic photoreceptors were prepared in the same manner as in Example 2, except that various arylamine type compounds shown in the following Table 2 prepared in the same manner as in the above Preparation Example were used in place of the arylamine type compound used in Example 1, and were measured with respect to sensitivities and residual potentials, the measured values of which are shown in the following Table 2.

TABLE 2

| Example | Compound No. | Sensitivity ($\mu$J/cm$^2$) | Residual potential (V) |
|---|---|---|---|
| 11 | 4 | 0.13 | −25 |
| 12 | 6 | 0.13 | −17 |
| 13 | 7 | 0.17 | −23 |

TABLE 2-continued

| Example | Compound No. | Sensitivity ($\mu J/cm^2$) | Residual potential (V) |
|---|---|---|---|
| 14 | 8 | 0.23 | −23 |
| 15 | 14 | 0.14 | −19 |

EXAMPLES 16 to 24

Electrophotographic photoreceptors were prepared in the same manner as in Example 3, except that various arylamine type compounds shown in the following Table 2 prepared in the same manner as in the above Preparation Example were used in place of the arylamine type compound used in Example 1, and were measured with respect to sensitivities and residual potentials, the measured values of which are shown in the following Table 3.

TABLE 3

| Example | Compound No. | Sensitivity (lux · sec) | Residual potential (V) |
|---|---|---|---|
| 16 | 2 | 0.50 | −2 |
| 17 | 3 | 0.53 | −2 |
| 18 | 4 | 0.48 | −2 |
| 19 | 7 | 0.66 | −15 |
| 20 | 8 | 0.60 | −17 |
| 21 | 9 | 0.48 | −2 |
| 22 | 27 | 0.70 | −25 |
| 23 | 36 | 0.75 | −30 |
| 24 | 38 | 0.82 | −34 |

COMPARATIVE EXAMPLE 1

An electrophotographic photoreceptor was prepared in the same manner as in Example 1, except that the following Comparative Compound 1 was used in place of the arylamine type compound used in Example 1.

COMPARATIVE COMPOUND 1

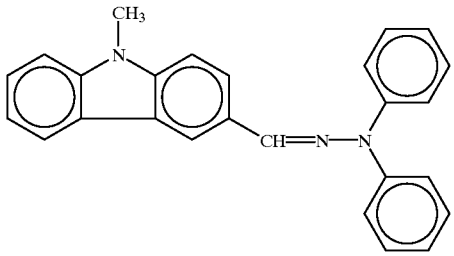

The comparative electrophotographic photoreceptor thus obtained was measured with respect to a sensitivity and a residual potential in the same manner as in Example 1, the measured values of which are shown in the following Table 4, together with the measured value of the electrophotographic photoreceptor of Example 1.

COMPARATIVE EXAMPLE 2

An electrophotographic photoreceptor was prepared in the same manner as in Comparative Example 1, except that the following Comparative Compound 2 was used in place of the Comparative Compound 1 used in Comparative Example 1, and was measured with respect to a sensitivity and a residual potential, the measured values of which are shown in the following Table 4.

COMPARATIVE COMPOUND 2

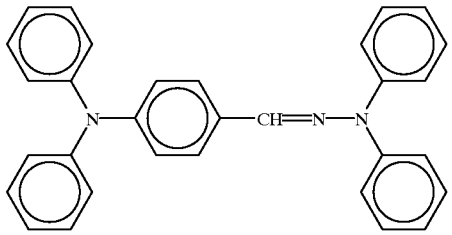

COMPARATIVE EXAMPLE 3

An electrophotographic photoreceptor was prepared in the same manrer as in Comparative Example 1, except that the following Comparative Compound 3 was used in place of the Comparative Compound 1 used in Comparative Example 1, and was measured with respect to a sensitivity and a residual potential, the measured values of which are shown in the following Table 4.

COMPARATIVE COMPOUND 3

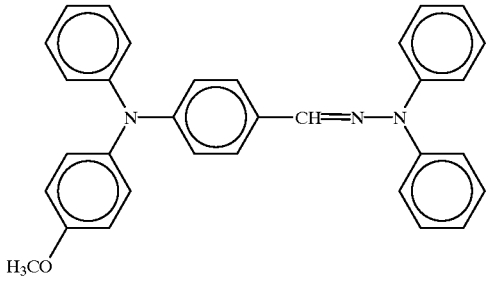

COMPARATIVE EXAMPLE 4

An electrophotographic photoreceptor was prepared in the same manner as in Comparative Example 1, except that the following Comparative Compound 4 was used in place of the Comparative Compound 1 used in Comparative Example 1, and was measured with respect to a sensitivity, a residual potential and a mobility, the measured values are shown in the following Table 4 and FIG. 1.

COMPARATIVE COMPOUND 4

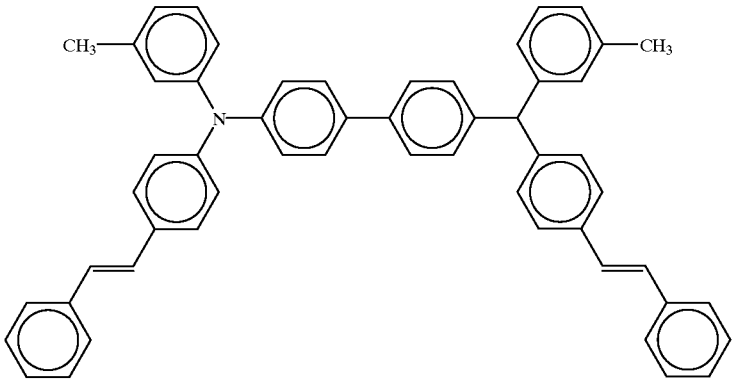

COMPARATIVE EXAMPLE 5

An electrophotographic photoreceptor was prepared in the same manner as in Comparative Example 1, except that the following Comparative Compound 5 was used in place of the Comparative Compound 1 used in Comparative Example 1, and was measured with respect to a sensitivity and a residual potential, the measured values of which are shown in the following Table 4.

COMPARATIVE COMPOUND 5

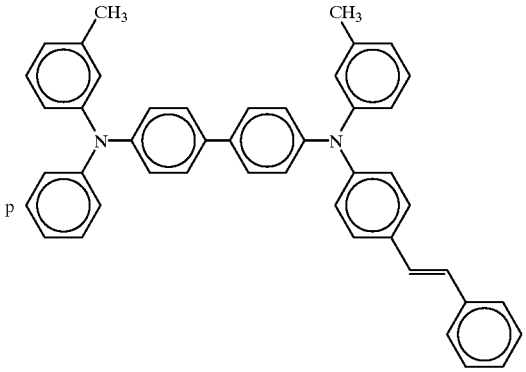

COMPARATIVE EXAMPLE 6

An electrophotographic photoreceptor was prepared in the same manner as in Comparative Example 1, except that the following Comparative Compound 6 was used in place of the Comparative Compound 1 used in Comparative Example 1, and was measured with respect to a sensitivity, a residual potential and a hole drift mobility, the measured values of which are shown in the following Table 4 and FIG. 1.

COMPARATIVE COMPOUND 6

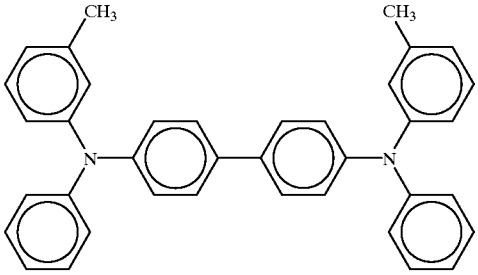

COMPARATIVE EXAMPLE 7

The same procedure as in Example 2 was repeated, except that the following arylamine compound was used, and a sensitivity was 0.78 lux.sec and a residual potential was −55 V.

COMPARATIVE COMPOUND 7

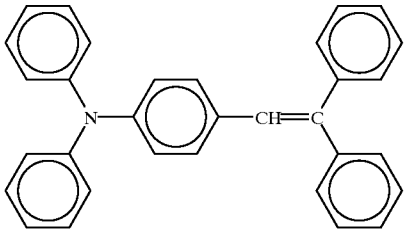

COMPARATIVE EXAMPLE 8

An electrophotographic photoreceptor was prepared in the same manner as in Example 1, except that the following Comparative Compound 8 was used in place of the arylamine type compound used in Example 1, and was measured with respect to a sensitivity, a residual potential and a hole drift mobility, the measured values of which are shown in the following Table 4 and FIG. 1.

COMPARATIVE COMPOUND 8

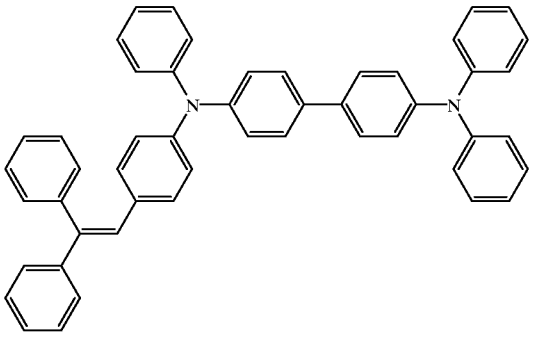

COMPARATIVE EXAMPLE 9

An electrophotographic photoreceptor was prepared in the same manner as in Example 1, except that the following Comparative Compound 9 was used in place of the arylamine type compound used in Example 1, and was measured with respect to a sensitivity, a residual potential and a hole drift mobility, the measured values of which are shown in the following Table 4 and FIG. 1.

COMPARATIVE COMPOUND 9

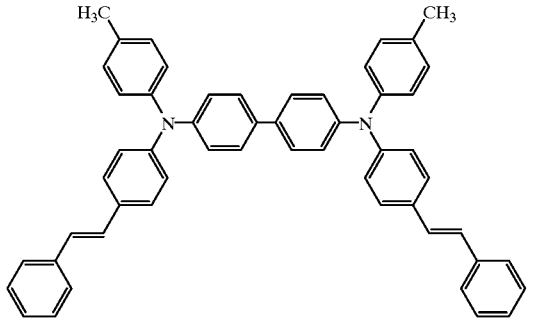

TABLE 4

| Example | Sensitivity ($\mu$J/cm$^2$) | Residual potential (V) |
|---|---|---|
| Comparative Example 1 | 0.60 | −27 |
| Comparative Example 2 | 0.59 | −12 |
| Comparative Example 3 | 0.59 | −11 |
| Comparative Example 4 | 0.48 | −11 |
| Comparative Example 5 | 0.51 | −13 |
| Comparative Example 6 | 0.49 | −10 |
| Comparative Example 8 | 0.47 | −6 |
| Comparative Example 9 | 0.45 | −7 |
| Example 1 | 0.46 | −6 |

It is evident from Table 4 that the compound of Example 1 provides superior sensitivity and residual potential values as compared with the compounds of Comparative Examples 1, 2, 3, 4, 5 and 6. Also, it is evident from FIG. 1 that the compound of Example 1 provides a much higher hole drift mobility as compared with Comparative Examples 4, 6, 8 and 9.

The electrophotographic photoreceptor of the present invention has a very high sensitivity and a very low residual potential which causes fogging, and since a light fatigue is small, accumulation of a residual potential is small and variation in a surface potential and a sensitivity is also small even when repeatedly used, thus providing an excellent durability.

I claim:

1. An electrophotographic photoreceptor having a photosensitive layer containing a charge-generating material and a charge-transporting material on an electroconductive substrate, wherein the charge-transporting material has an optionally substituted biphenyl group and a butadiene structure and a total amount W of $\pi$ electron number and lone electron number of nitrogen of the charge-transporting material is at least 60.

2. The electrophotographic photoreceptor according to claim 1, wherein W is from 60 to 80.

3. The electrophotographic photoreceptor according to claim 1, wherein the lone electron number of nitrogen of the charge-transporting material is 4.

4. The electrophotographic photoreceptor according to claim 1, wherein a value L obtained by dividing the lone electron number of nitrogen of the charge-transporting material by the $\pi$ electron number is at most 0.075.

5. The electrophotographic photoreceptor according to claim 1, wherein a value W/Mw obtained by dividing the total amount W of $\pi$ electron number and lone electron number of nitrogen of the charge-transporting material by molecular weight Mw is at least 0.065.

6. The electrophotographic photoreceptor according to claim 1, wherein the charge-transporting material is composed of nitrogen, carbon and hydrogen only.

* * * * *